US008725297B2

(12) United States Patent
Oishi et al.

(10) Patent No.: US 8,725,297 B2
(45) Date of Patent: May 13, 2014

(54) SHEET PAPER STORAGE AND DISPENSING DEVICE

(75) Inventors: Taki Oishi, Tokyo (JP); Masaaki Egashira, Saitama (JP); Masaru Suwa, Saitama (JP); Katsuhiko Uehara, Saitama (JP)

(73) Assignee: Laurel Precision Machines Co., Ltd., Osaka-shi (JP)

( * ) Notice: Subject to any disclaimer, the term of this patent is extended or adjusted under 35 U.S.C. 154(b) by 687 days.

(21) Appl. No.: 12/579,659

(22) Filed: Oct. 15, 2009

(65) Prior Publication Data

US 2010/0100245 A1 Apr. 22, 2010

(30) Foreign Application Priority Data

Oct. 16, 2008 (JP) ..... P2008-267344

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05D 23/00*** | (2006.01) |
| ***B65H 5/22*** | (2006.01) |
| ***G03B 1/18*** | (2006.01) |
| ***G07D 7/00*** | (2006.01) |

(52) U.S. Cl.

USPC ..... 700/275; 271/3.01; 242/334.1; 242/528; 194/203

(58) Field of Classification Search

CPC ..... G05B 15/02; G05B 11/01; G05B 19/042; B65H 2701/1912; B65H 29/006; B65H 2301/41912; B65H 2403/72; G11B 15/43; G07F 1/043; G07F 1/044

USPC ..... 700/275; 271/3.01; 242/334.1, 528; 194/203

See application file for complete search history.

(56) References Cited

U.S. PATENT DOCUMENTS

| | | | |
|---|---|---|---|
| 3,733,036 | A | 5/1973 | Eitzenberger |
| 4,528,794 | A | 7/1985 | Thierstein |

(Continued)

FOREIGN PATENT DOCUMENTS

| | | |
|---|---|---|
| CN | 1573820 | 2/2005 |
| EP | 1 710 181 A1 | 10/2006 |

(Continued)

OTHER PUBLICATIONS

Notice of Allowance and English translation in Korean application 10-2009-0097678 dated Feb. 18, 2011.

(Continued)

*Primary Examiner* — Kavita Padmanabhan
*Assistant Examiner* — Jason Lin
(74) *Attorney, Agent, or Firm* — Nixon & Vanderhye P.C.

(57) ABSTRACT

A sheet paper storage and dispensing device stores and dispenses sheet paper, and includes a first reel drum onto which a tape is wound; a second reel drum on which sheet paper is stored; a motor which drives the first and second reel drums via a drive system; an electromagnetic clutch which switches between transmitting and interrupting drive force from the drive system; an electromagnetic brake which applies a brake to the drive system; a trigger sensor which detects supplying of the sheet paper; a tape speed detection section which detects a transporting speed at the intake/discharge port; a motor speed variation control unit which controls changes in a rotation speed; and a winding control unit which causes winding by controlling the electromagnetic clutch so as to transmit the driving force when supplying of the sheet paper to the intake/discharge port is detected by the trigger sensor.

6 Claims, 9 Drawing Sheets

(56) References Cited

U.S. PATENT DOCUMENTS

| | | | | |
|---|---|---|---|---|
| 4,953,843 | A | 9/1990 | Reist | |
| 5,116,043 | A | 5/1992 | Jermann et al. | |
| 5,735,516 | A | 4/1998 | Gerlier et al. | |
| 6,068,255 | A * | 5/2000 | Nicoll | 271/203 |
| 6,164,585 | A * | 12/2000 | Lutz | 242/528 |
| 6,170,822 | B1 * | 1/2001 | Kato et al. | 271/298 |
| 6,186,339 | B1 | 2/2001 | Saltsov et al. | |
| 6,296,242 | B1 * | 10/2001 | Saltsov et al. | 271/3.21 |
| 6,371,368 | B1 | 4/2002 | Owens et al. | |
| 6,371,473 | B1 | 4/2002 | Saltsov et al. | |
| 6,565,082 | B2 | 5/2003 | Sasaki et al. | |
| 6,568,673 | B2 | 5/2003 | Mochizuki et al. | |
| 6,669,136 | B2 | 12/2003 | Niioka et al. | |
| 7,192,020 | B2 * | 3/2007 | Hayashi et al. | 270/58.11 |
| 2002/0096816 | A1 | 7/2002 | Sasaki et al. | |
| 2002/0096818 | A1 | 7/2002 | Mochizuki et al. | |
| 2002/0113160 | A1 | 8/2002 | Niioka et al. | |
| 2004/0175217 | A1 * | 9/2004 | Nakamura et al. | 399/407 |
| 2005/0017428 | A1 | 1/2005 | Ichikawa et al. | |
| 2006/0169770 | A1 * | 8/2006 | Koshizuka et al. | 235/381 |
| 2006/0225986 | A1 * | 10/2006 | Oishi et al. | 194/203 |
| 2007/0051844 | A1 | 3/2007 | De Snoeck et al. | |

FOREIGN PATENT DOCUMENTS

| | | | | |
|---|---|---|---|---|
| JP | 08-096191 | | 4/1996 | |
| JP | 10181972 | A * | 7/1998 | B65H 23/192 |
| JP | 2002-160855 | | 6/2002 | |
| JP | 3534966 | | 3/2004 | |
| JP | 2004359369 | A * | 12/2004 | |
| JP | 2006-290513 | | 10/2006 | |
| JP | 2008-123093 | | 5/2008 | |
| KR | 10-2006-0107355 | A | 10/2006 | |
| KR | 10-2006-0130733 | A | 12/2006 | |
| TW | 321322 | | 11/1997 | |
| TW | 367471 | | 8/1999 | |
| WO | WO 03/030107 | A2 | 4/2003 | |

OTHER PUBLICATIONS

U.S. Appl. No. 11/397,569, Oishi, filed Apr. 5, 2006.
Office Action and English Translation for corresponding Japanese Application No. 2008-267344, mailed Apr. 17, 2012 7 pages.
English translation of Taiwanese Office Action and Search Report issued for Taiwanese Application No. 095112126, dated Apr. 14, 2008, 7 pages.
EP Search Report in EP 09 17 3123 mailed May 15, 2012.
Office Action and English Translation for corresponding Chinese Application No. 200910253038.9, issued Jul. 19, 2012, 19 pages.

* cited by examiner

SHEET PAPER STORAGE AND DISPENSING DEVICE

BACKGROUND OF THE INVENTION

1. Field of the Invention

The present invention relates to a sheet paper storage and dispensing device which stores and dispenses sheet paper by means of winding and unwinding a tape.

Priority is claimed on Japanese Patent Application No. 2008-267344, filed Oct. 16, 2008, the contents of which are incorporated herein by reference.

2. Description of Related Art

A sheet paper storage and dispensing device has already been developed that is used in banknote processors and the like and which has a first reel drum onto which a tape is wound from one side thereof, and a second reel drum which laminates the tape onto sheet paper while the tape is being wound onto it from the opposite side. In this type of sheet paper storage and dispensing device, the sheet paper is wound onto the second reel drum together with the tape and is stored thereon when the second reel drum is rotated in one direction, and the sheet paper which is stored on the second reel drum is fed out together with the tape when the second reel drum is rotated in the opposite direction.

For example, Japanese Patent Publication No. 3534966 discloses a technology in which, in a sheet paper storage and dispensing device which stores and dispenses sheet paper using tape such as that described above, any slackness in the tape is restricted and the winding speed can be varied in accordance with the tape wind amount.

However, in the aforementioned sheet paper storage and dispensing device, the conveyance speed of the tape is estimated from the diameter of the outer circumference of the tape which is wound onto the drum, and this varies depending on the number of winds of the tape around the drum and on the number of winds of the sheet paper around the drum. Accordingly, it has not been possible to precisely measure the transporting speed of the tape. Because of this, it has been difficult to keep the conveyance speed of the tape at a precise, predetermined constant speed, and it has not been possible to obtain sheet paper from an intake/discharge port at suitable fixed intervals. As a result of this, it has not been possible to supply sheet paper to the outside via an intake/discharge port at suitable fixed intervals.

SUMMARY OF THE INVENTION

It is an object of the present invention to provide a sheet paper storage and dispensing device which makes it possible to easily and accurately measure the transporting speed of a tape.

A sheet paper storage and dispensing device according to a first aspect of the present invention stores and dispenses sheet paper, and includes: a first reel drum onto which a tape is wound from one side of the tape; a second reel drum on which sheet paper is stored by winding the tape thereon from an opposite side of the tape in a state in which the tape and sheet paper supplied from an external sheet paper transporting section to an intake/discharge port are mutually superimposed; a motor which drives the first reel drum and the second reel drum via a drive system; an electromagnetic clutch which switches between transmitting and interrupting drive force from the drive system; an electromagnetic brake which applies a brake to the drive system; a trigger sensor which detects supplying of the sheet paper from the sheet paper transporting section to the intake/discharge port; a tape speed detection section which detects a transporting speed of the tape at the intake/discharge port; a motor speed variation control unit which controls changes in a rotation speed of the motor; and a winding control unit which causes a winding operation by controlling the electromagnetic clutch so as to transmit the driving force of the motor when supplying of the sheet paper to the intake/discharge port is detected by the trigger sensor, the winding operation being a operation in which the tape is dispensed from the first reel drum while the tape is wound onto the second reel drum, so that the sheet paper supplied to the intake/discharge port is wound onto the second reel drum, and the winding control unit controls the motor speed variation control unit such that, during the winding operation, the transporting speed of the tape detected by the tape speed detection unit is held at a fixed speed which is faster by a predetermined amount than a transporting speed of the sheet paper transporting section.

According to the above described structure, a tape speed detection section detects the transporting speed of a tape at an intake/discharge port. Because of this, it is possible to easily and accurately measure the transporting speed of the tape. Moreover, during a winding operation which commences when the supplying of sheet paper to the intake/discharge port is detected by a trigger sensor, the winding control unit controls the motor speed variation control unit such that the transporting speed of the tape which is detected by the tape speed detection unit is held at a fixed speed which is faster by a predetermined amount than the transporting speed of the sheet paper transporting section. Because of this, the sheet paper which is supplied from the sheet paper transporting section can be taken in safely.

A sheet paper storage and dispensing device according to a second aspect of the present invention stores and dispenses sheet paper, and includes: a first reel drum onto which a tape is wound from one side of the tape; a second reel drum on which sheet paper is stored by winding the tape thereon from an opposite side of the tape in a state in which the tape and sheet paper supplied from an external sheet paper transporting section to an intake/discharge port are mutually superimposed; a motor which drives the first reel drum and the second reel drum via a drive system; an electromagnetic clutch which switches between transmitting and interrupting drive force from the drive system; an electromagnetic brake which applies a brake to the drive system; a tape speed detection section which detects the transporting speed of the tape at the intake/discharge port; a motor speed variation control unit which controls changes in a rotation speed of the motor; a dispensing end detection section which detects that dispensing of the tape from the second reel drum is ended; and an unwinding control unit which, during an unwinding operation, when end of dispensing of the tape is detected by the dispensing end detection section, controls the electromagnetic clutch so as to interrupt transmitting of the driving force of the motor, and controls the electromagnetic brake so as to apply a brake to the drive system, the unwinding operation being an operation in which the tape is dispensed from the second reel drum while the tape is wound onto the first reel drum, so that the sheet paper stored on the second reel drum is fed from the intake/discharge port to the sheet paper transporting section, and the unwinding control unit controls the motor speed variation control unit such that, during the unwinding operation, the transporting speed of the tape detected by the tape speed detection unit is held at a fixed speed which is slower by a predetermined amount than a transporting speed of the sheet paper transporting section.

According to the above described structure, a tape speed detection section detects the transporting speed of a tape at an intake/discharge port. Because of this, it is possible to easily and accurately measure the transporting speed of the tape. Moreover, during an unwinding operation, the unwinding control unit controls the motor speed variation control unit such that the transporting speed of the tape which is detected by the tape speed detection unit is held at a fixed speed which is slower by a predetermined amount than the transporting speed of the sheet paper transporting section. Because of this, the sheet paper which is to be dispensed to the sheet paper transporting section can be transferred safely to the sheet paper transporting section.

A sheet paper storage and dispensing device according to a third aspect of the present invention stores and dispenses sheet paper, and includes: a first reel drum onto which a tape is wound from one side of the tape; a second reel drum on which sheet paper is stored by winding the tape thereon from an opposite side of the tape in a state in which the tape and sheet paper supplied from an external sheet paper transporting section to an intake/discharge port are mutually superimposed; a motor which drives the first reel drum and the second reel drum via a drive system; an electromagnetic clutch which switches between transmitting and interrupting drive force from the drive system; an electromagnetic brake which applies a brake to the drive system; a trigger sensor which detects supplying of the sheet paper from the sheet paper transporting section to the intake/discharge port; a tape speed detection section which detects a transporting speed of the tape at the intake/discharge port; a motor speed variation control unit which controls changes in a rotation speed of the motor; a dispensing end detection section which detects that dispensing of the tape from the second reel drum is ended; a winding control unit which causes a winding operation by controlling the electromagnetic clutch so as to transmit the driving force of the motor when supplying of the sheet paper to the intake/discharge port is detected by the trigger sensor, the winding operation being a operation in which the tape is dispensed from the first reel drum while the tape is wound onto the second reel drum, so that the sheet paper supplied to the intake/discharge port is stored on the second reel drum; and an unwinding control unit which, during an unwinding operation, when end of dispensing of the tape is detected by the dispensing end detection section, controls the electromagnetic clutch so as to interrupt transmitting of the driving force of the motor, and controls the electromagnetic brake so as to apply a brake to the drive system, the unwinding operation being an operation in which the tape is dispensed from the second reel drum while the tape is wound onto the first reel drum, so that the sheet paper stored on the second reel drum is fed from the intake/discharge port to the sheet paper transporting section, the winding control unit controls the motor speed variation control unit such that, during the winding operation, the transporting speed of the tape detected by the tape speed detection unit is held at a fixed speed which is faster by a predetermined amount than a transporting speed of the sheet paper transporting section, and the unwinding control unit controls the motor speed variation control unit such that, during the unwinding operation, the transporting speed of the tape detected by the tape speed detection unit is held at a fixed speed which is slower by a predetermined amount than a transporting speed of the sheet paper transporting section.

According to the above described structure, a tape speed detection section detects the transporting speed of a tape at an intake/discharge port. Because of this, it is possible to easily and accurately measure the transporting speed of the tape. Moreover, during a winding operation which commences when the supplying of sheet paper to the intake/discharge port is detected by a trigger sensor, the winding control unit controls the motor speed variation control unit such that the transporting speed of the tape which is detected by the tape speed detection unit is held at a fixed speed which is faster by a predetermined amount than the transporting speed of the sheet paper transporting section. Because of this, the sheet paper which is supplied from the sheet paper transporting section can be taken in safely. Moreover, during an unwinding operation, the unwinding control unit controls the motor speed variation control unit such that the transporting speed of the tape which is detected by the tape speed detection unit is held at a fixed speed which is slower by a predetermined amount than the transporting speed of the sheet paper transporting section. Because of this, the sheet paper which is to be dispensed to the sheet paper transporting section can be transferred safely to the sheet paper transporting section.

In the sheet paper storage and dispensing device according to the above described first through third aspects of the present invention, the tape speed detection section may be provided on a feed roller which is provided at the intake/discharge port and mutually superimposes the tape and the sheet paper.

According to the above described structure, because the tape speed detection section is provided on a feed roller which is provided at the intake/discharge port and mutually superimposes the tape and the sheet paper, positioning the tape speed detection section is simplified.

In the sheet paper storage and dispensing device according to the above described first through third aspects of the present invention, a tape dispensing position may be calculated using a pulse number of the motor speed variation control unit.

According to the above described structure, because the tape dispensing position is detected by calculation using a pulse number of the motor speed variation control unit, it is possible to accurately detect the end of the dispensing of the tape in a winding operation and also a point near this end, and to detect the end of the dispensing of the tape in an unwinding operation and also a point near this end.

DETAILED DESCRIPTION OF THE INVENTION

A sheet paper storage and dispensing device according to an embodiment of the present invention will now be described with reference made to the drawings.

A sheet paper storage and dispensing device 1 of the present embodiment may be used as a temporary holding section or as storage sections for different denominations of currency of an automated teller machine which handles banknotes S as a type of sheet paper. The sheet paper storage and dispensing device 1 replaces a conventional sheet paper storage and dispensing device which collects and retains banknotes within a conventional box-shaped space, and which dispenses one banknote at a time from the bottom or the top. The sheet paper storage and dispensing device 1 of the present embodiment may handle currency banknotes whose size varies greatly depending on the denomination, and transports and store the banknotes such that the longitudinal direction thereof is aligned with the transporting direction.

Figure 1:
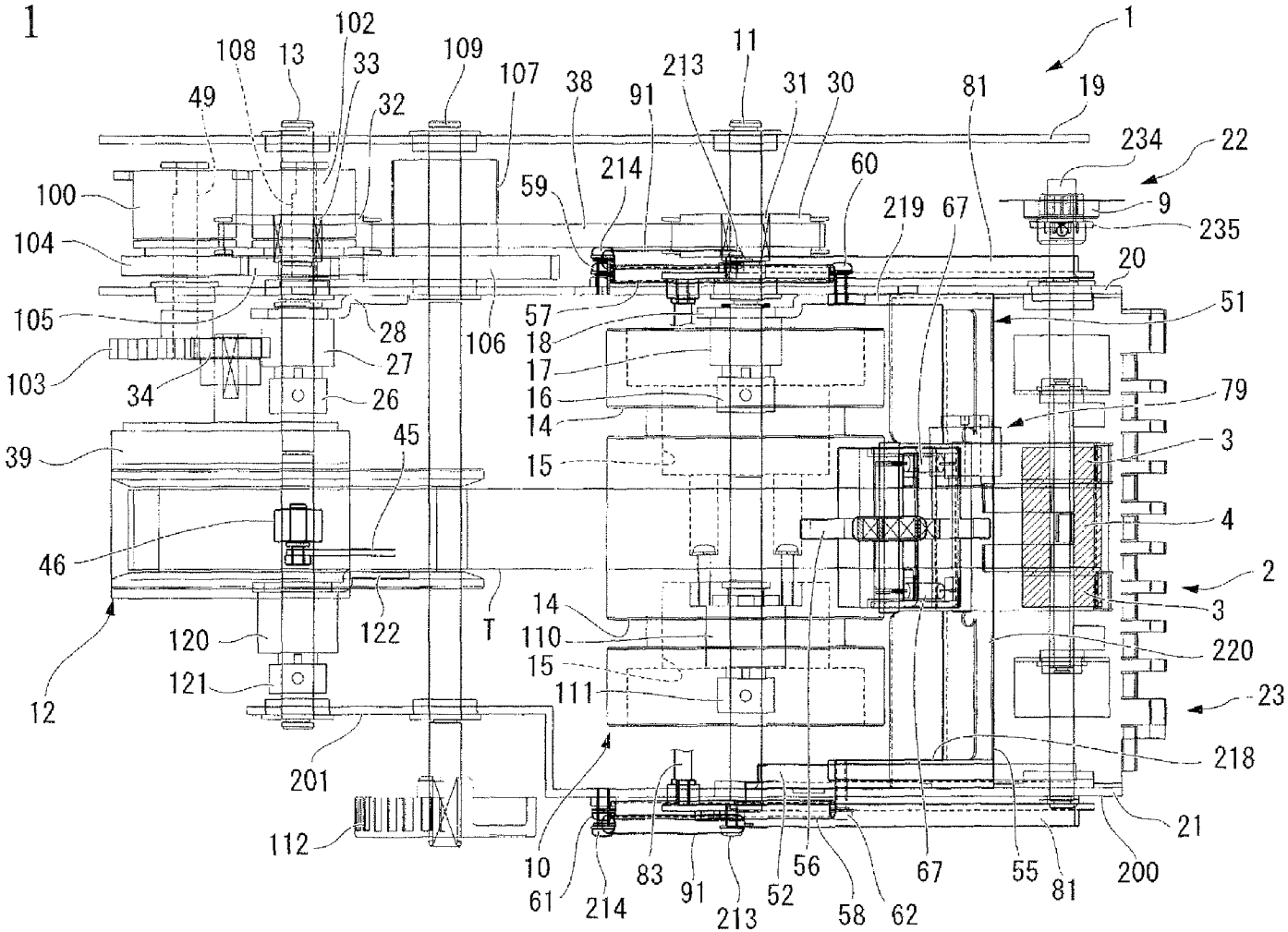
FIG. 1 is a transparent plan view showing a sheet paper storage and dispensing device according to an embodiment of the present invention.

As is shown in FIG. 1, the sheet paper storage and dispensing device 1 of the present embodiment is separated into a drive system space 22 and a collection space 23. The drive system space 22 is sandwiched between a side plate 19 (shown in FIG. 1) which is aligned vertically, and a supporting plate 20 which is provided parallel with the side plate 19. The collection space 23 is sandwiched between the supporting plate 20 and a side plate 21 which is provided parallel with the side plate 19 and on the opposite side therefrom. The side plate 19 and the side plate 20 are formed as flat plates. The side plate 21 has a stepped shape. One side of the side plate 21 forms a main plate portion 200, while the opposite side thereof forms a stepped plate portion 201. The main plate portion 200 is parallel with the side plate 19 and the supporting plate 20. The stepped plate portion 201 is parallel with the side plate 19 and the supporting plate 20, and is closer than the main plate portion 200 to the supporting plate 20. The side plate 19, the supporting plate 20, and the side plate 21 are joined together by means of a plurality of pins or the like (not shown).

Figure 2:
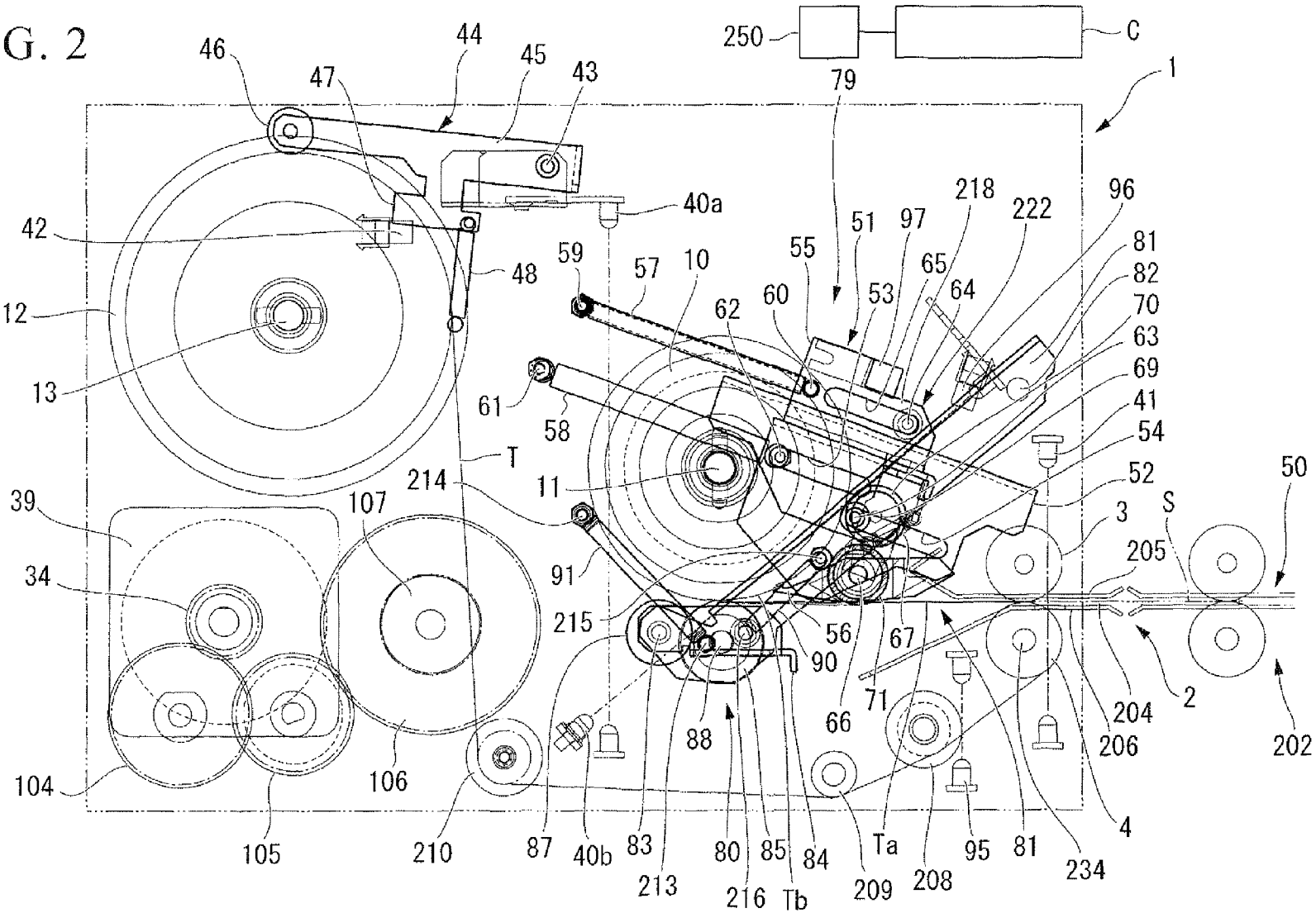
FIG. 2 is a transparent plan view showing a state in which a tape has been partially wound onto a side of a banknote collection drum in the sheet paper storage and dispensing device of the embodiment of the present invention.
Figure 3:
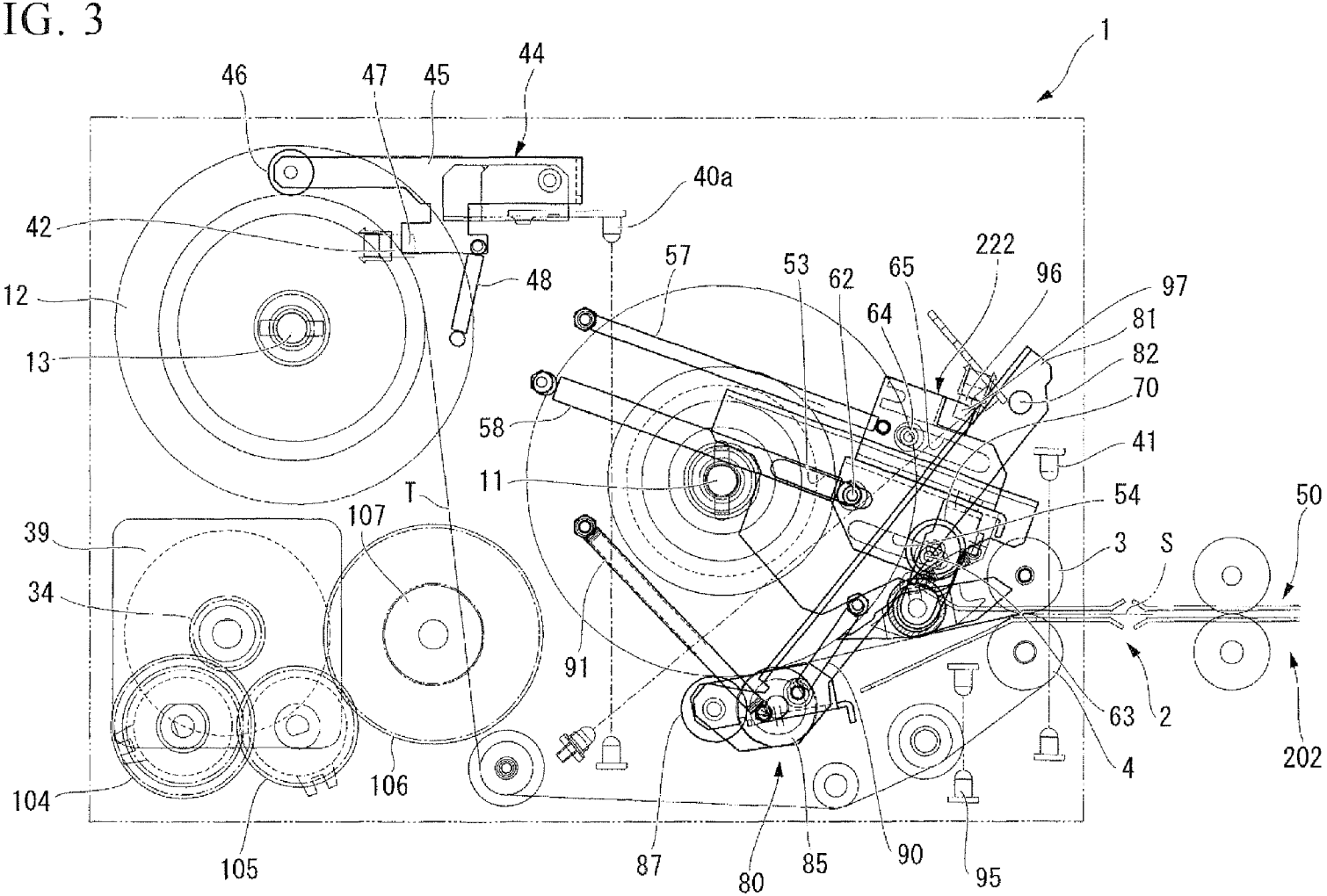
FIG. 3 is a transparent plan view showing a state in which the tape has been wound to the maximum limit onto the side of the banknote collection drum in the sheet paper storage and dispensing device of the embodiment of the present invention.
Figure 4:
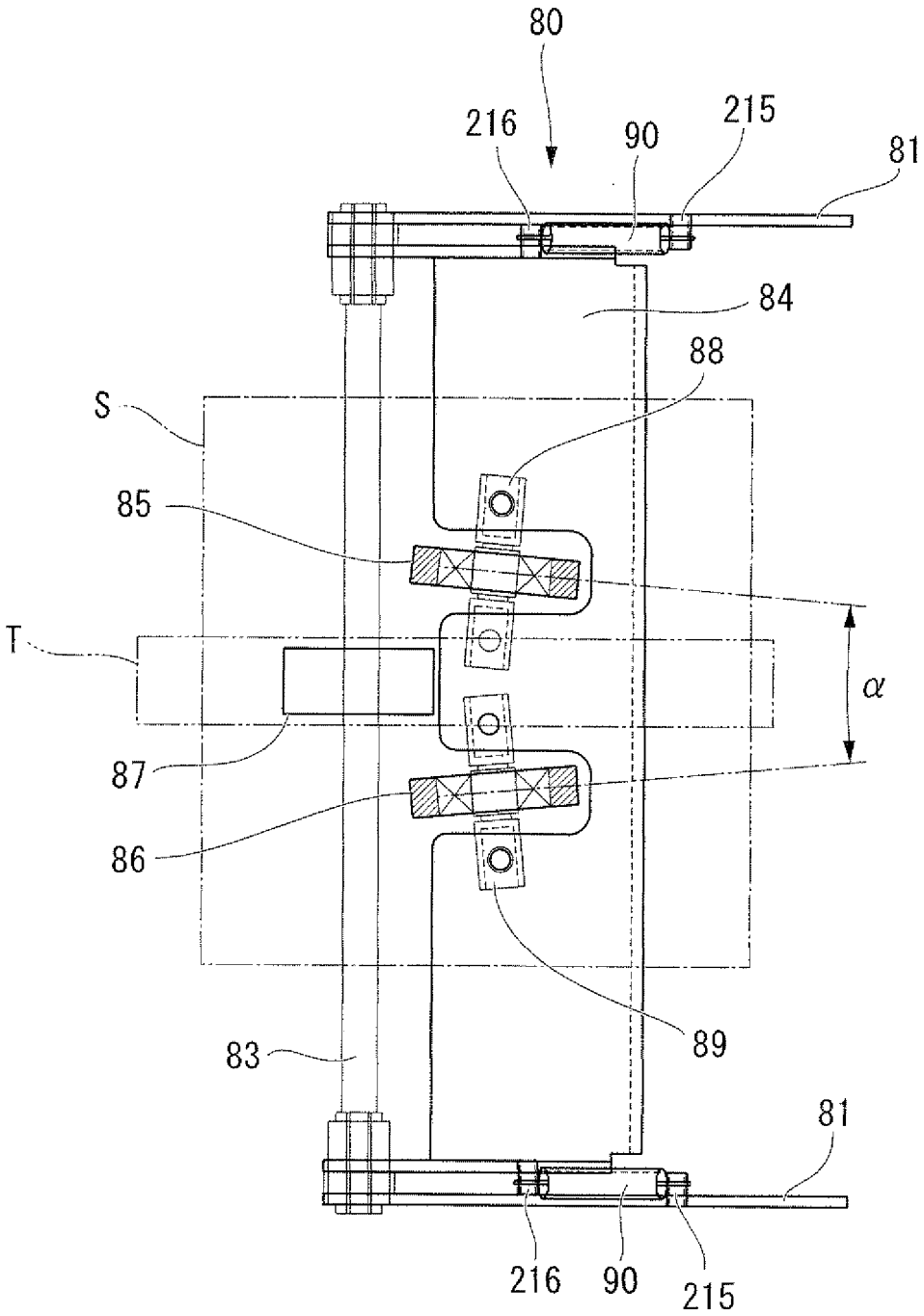
FIG. 4 is a transparent view showing principal portions of a banknote separation facilitating mechanism in the sheet paper storage and dispensing device of the embodiment of the present invention.
Figure 5:
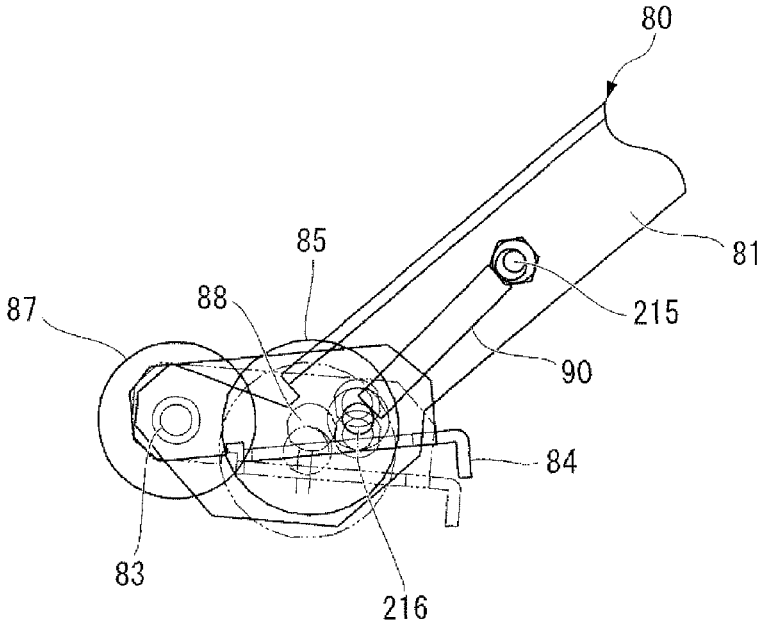
FIG. 5 is a transparent side view showing principal portions of the banknote separation facilitating mechanism in the sheet paper storage and dispensing device of the embodiment of the present invention.
Figure 6:
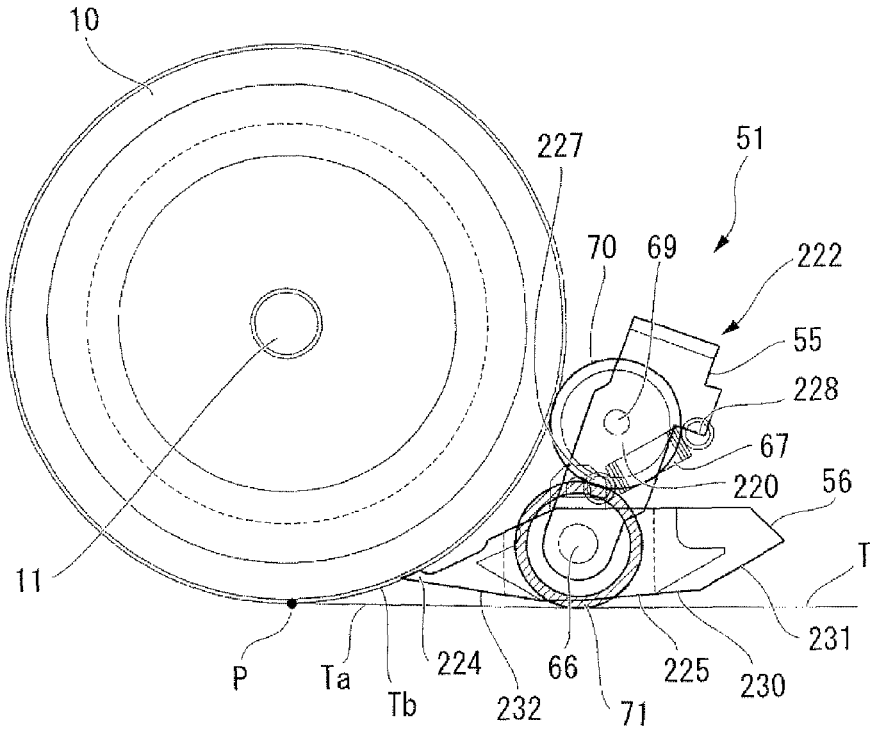
FIG. 6 is a transparent side view showing principal portions of a banknote separation mechanism in the sheet paper storage and dispensing device of the embodiment of the present invention.

As is shown in FIG. 2 and FIG. 3, in the collection space 23, there is provided an intake/discharge port 2 which is connected to a transporting path (i.e., an external sheet paper transporting section) 50 on a main body 202 side of the automatic teller machine in which the sheet paper storage and dispensing device 1 has been placed. At the intake/discharge port 2, banknotes S are received from and dispensed to the main body 202 side. This intake/discharge port 2 has a pair of guide plate portions 205 and 206 and a top roller 3 and bottom roller 4, and is aligned substantially horizontally. The pair of guide plate portions 205 and 206 are positioned vertically above and below so as to extend horizontally and thereby form a passage 204 between them for the banknotes S to pass along. The top roller 3 and the bottom roller 4 are a pair of parallel feed rollers which are able to make contact with each other and are provided facing each other vertically such that they both protrude onto the passage 204 between the guide plate portions 205 and 206.

A tape T, one side of which is drawn out and is fixed to a banknote collection drum (i.e., a second reel drum) 10, is looped around the bottom roller 4 of the intake/discharge port 2 so as to be able to pass between the bottom roller 4 and the top roller 3. The banknote collection drum 10 is placed towards the rear as seen from the intake/discharge port 2, and is parallel with the bottom roller 4. This tape T substantially reverses the direction in which it extends after being looped around the bottom roller 4, and its path of travel is formed by a plurality of, more specifically, by three rollers 208, 209, and 210. The other side of the tape T is fixed to a tape wind-on drum (i.e., a first reel drum) 12 which is parallel with the banknote collection drum 10. An intake/discharge area Ta of the tape T which links together the banknote collection drum 10 and the bottom roller 4 substantially matches the direction in which the passage 204 of the intake/discharge port 2 extends. This bottom roller 4 is rotated by contact tension from the tape T, namely, is rotated in conjunction with the traveling of the tape T. The top roller 3 is also rotated in conjunction with the traveling of the tape T or of the banknotes S which are superimposed on the tape T and move integrally therewith. The rollers 208, 209, and 210 which are used to guide the tape T are also rotated by contact tension from the tape T.

The banknotes S which have been transported from the transporting path 50 while being separated into individual banknotes are fed at a uniform speed from the transporting path 50 to the passage 204 between the pair of guide plate portions 205 and 206 of the intake/discharge portion 2 by the transporting drive force on the transporting path 50 side. Then, a central position in the direction of the short sides of each banknote S is superimposed onto the tape T on the passage 204 by the top roller 3 and the bottom roller 4. Next, the banknotes S are transported together with the tape T, and are wound onto the banknote collection drum 10 together with the tape T so as to be collected and stored thereon. Specifically, the banknotes S are superimposed onto the top roller 3 side of the tape T by the top roller 3 and the bottom roller 4. The banknotes S move over the rectilinear intake/discharge area Ta together with the portion of the tape T on which they are superimposed. A wind outer circumferential area Tb is formed by the outermost circumferential portion of those portions of the tape T which are already wound onto the banknote collection drum 10 and are adjacent to the upstream side of the intake/discharge area Ta in the rotation direction of the banknote collection drum 10. Next, the banknotes S are wound onto the tape T which has already been wound onto the banknote collection drum 10 from a border position between the intake/discharge area Ta and the wind outer circumferential area Tb, and are gripped between the tape T and the banknote collection drum 10. As a result of the banknotes S being sequentially wound onto the banknote collection drum 10 together with the tape T in this manner, they are collected on the banknote collection drum 10.

Conversely, when the portion of the tape T which is already superimposed on the banknotes S travels away from the banknote collection drum 10 and reaches the rectilinear intake/discharge area Ta, the banknotes S which have already been collected on the banknote collection drum 10 move away from the wind outer circumferential area Tb together with the tape T and are dispensed. Next, the banknotes S are separated from the tape T at the intake/discharge port 2, and are dispensed onto the transporting path 50 whose transporting direction has been reversed from that described above at the same uniform speed as is mentioned above.

The tape wind-on drum 12 and the banknote collection drum 10 rotate in a predetermined banknote storage direction (i.e., in a clockwise direction in FIG. 2 and FIG. 3). By rotating in this direction, the tape T is wound onto the banknote collection drum 10 as it is being dispensed from the tape wind-on drum 12, and the banknotes S are fed from the transporting path 50 to the intake/discharge aperture 2 and are stored on the banknote collection drum 10. This is the winding operation.

The tape wind-on drum 12 and the banknote collection drum 10 also rotate in a predetermined banknote dispensing direction which is the reverse of that described above (i.e., in an anti-clockwise direction in FIG. 2 and FIG. 3). By rotating in this direction, the tape T is dispensed from the banknote collection drum 10 while only the tape T is being wound onto the tape win-on drum 12, so that the banknotes S which were stored on the banknote collection drum 10 are fed from the intake/discharge port 2 to the transporting path 50. This is the unwinding operation.

In this manner, by performing the winding operation and the unwinding operation for the tape T between the tape wind-on drum 12 and the banknote collection drum 10, the banknotes S can be stored or dispensed. The two ends of the tape T (i.e., the start end and the finish end) are attached by an attachment component (not shown) to the outer circumferential surface of the corresponding one of the banknote collection drum 10 and the tape wind-on drum 12, and are then wound on.

The banknote collection drum 10 has an axial length which is somewhat greater than the length of the short side of the largest of the banknotes S which are transported with the longitudinal direction thereof being aligned in the transporting direction. The banknote collection drum 10 is supported on a shaft 11 which is aligned parallel with the top roller 3 and the bottom roller 4, namely, is aligned horizontally, and is able to rotate around this shaft 11.

As is shown in FIG. 1, a groove 14 is formed in the outer circumferential surface of the banknote collection drum 10 in a toroidal shape which runs in the circumferential direction. The groove 14 forms a path for sensor light which is used to detect whether or not banknotes are present. Recessed portions 15 whose grooves are centered around the shaft 11 are formed in both ends in the axial direction of the banknote collection drum 10.

The tape wind-on drum 12 is rotatably supported on a shaft 13 which is parallel with the rollers 3 and 4 at a position diagonally opposite the intake/discharge port 2 within the collection space 23.

The tape wind-on drum 12 dispenses the tape T when banknotes S are being collected, and, conversely, takes up excess tape T when the collected banknotes S are being dispensed. Because the tape wind-on drum 12 only winds on the tape T which has a narrower width than that of the banknotes S in a superimposed state, the axial length thereof is shorter than that of the banknote collection drum 10, and here is set so as to be substantially the same as the width of the tape T.

In the present embodiment, a banknote separating section 79 is placed adjacent to the banknote collection drum 10. In the state of banknotes S being dispensed from the banknote collection drum 10, when the portion of the tape T which is supporting the banknotes S on the outer side reaches the intake/discharge area Ta, the banknote separating section 79 separates the banknotes S which are supported by this portion from the wind outer circumferential area Tb, which is the portion of the tape T which has not yet been wound onto the banknote collection drum 10, and leads the banknotes S to the intake/discharge area Ta together with the tape T. Namely, principally, the banknote separating section 79 is put to use when the banknotes S which have been collected on the banknote collection drum 10 are dispensed therefrom, and enables the dispensed banknotes S to be reliably separated from the banknote collection drum 10.

This banknote separating section 79 includes a banknote separation facilitating mechanism 80 and a banknote separating mechanism (i.e., separating section) 51. The banknote separation facilitating mechanism 80 is on the upstream side in the direction in which the banknotes S are dispensed, and is placed in contact with the banknote S which is closest to the dispensing side from among the banknotes S which are wound around the banknote collection drum 10. The banknote separation facilitating mechanism 80 facilitates the separation of this banknote S from the wind outer circumferential area Tb. The banknote separating mechanism 51 is located in a position immediately on the downstream side in the dispensing direction of the banknotes S, and is provided on the tape T dispensing side, namely, on the bottom roller 4 side of the banknote collection drum 10. The banknote separating mechanism 51 separates banknotes S from the wind outer circumferential area Tb which is wound around the banknote collection drum 10 and causes them to travel to the intake/discharge area Ta together with the tape T.

As is shown in FIG. 1 through FIG. 5, the banknote separation facilitating mechanism 80 has a pair of shafts 82 which are parallel with the banknote collection drum 10. These shafts 82 are placed in the supporting plate 20 and the side plate 21 so as to be mutually coaxial. When viewed from the axial direction of the drum, these shafts 82 are provided above the intake/discharge area Ta of the tape T.

The banknote separation facilitating mechanism 80 has a pair of arm components 81 and a shaft 83 which are positioned on the opposite side of the collection space 23 from each of the pair of the shafts 82. The pair of arm components 81 are able to oscillate around the shafts 82. The shaft 83 joins together end portions of the pair of arm components 81 on the opposite side from the shafts 82, and is parallel with the shafts 82. The pair of arm components 81 are mutually parallel, and when viewed from the axial direction of the drum, front portions thereof extend downwards to a position beyond the intake/discharge area Ta of the tape T.

The banknote separation facilitating mechanism 80 has a base component 84 is supported on the shaft 83 so as to be able to oscillate around the shaft 83 in the state of extending between the respective arm components 81. Namely, the base component 84 is supported so as to be able to oscillate around the arm components 81 which are also able to oscillate.

The base component 84 is provided with a pair of shafts 88 and 89. The shafts 88 and 89 are provided on the outer side, namely, on the bottom side of a boundary position between the intake/discharge area Ta and the wind outer circumferential area Tb on the outer most circumference of the tape T which is wound around the banknote collection drum 10 so as to sandwich the tape T from both sides in the axial direction of the banknote collection drum 10. A separation facilitating roller 85 and a separation facilitating roller 86 are rotatably provided respectively on the shaft 88 and the shaft 89. Namely, the pair of separation facilitating rollers 85 and 86 are held via the shafts 88 and 89 on the base component 84. When viewed from the drum radial direction, the pair of shafts 88 and 89 are inclined such that opposing sides thereof are positioned on the downstream side in the dispensing direction when the banknotes S are being dispensed from the banknote collection drum 10. As a result, the pair of separation facilitating rollers 85 and 86 are uniformly inclined such that the gap between them narrows as it approaches the downstream side in the dispensing direction in which the banknotes S are dispensed from the banknote collection drum 10, namely, as it approaches the intake/discharge port 2 side. In other words, the pair of separation facilitating rollers 85 and 86 are arranged in a V shape which tapers in on the intake/discharge port 2 side. The specific angle of inclination of the shafts 88 and 89 is set such that an angle of intersection $\alpha$ of orthogonal lines extending from the center axes of each shaft is approximately 10°. The minimum distance between the pair of separation facilitating rollers 85 and 86 is wider than the width of the tape T, and the pair of separation facilitating rollers 85 and 86 are placed in positions on the two outer sides of the tape T and away from the tape T, namely, such that they do not make contact with the tape T.

The shaft 83 joins together the pair of arm components 81 and also supports the base component 84. An auxiliary roller 87 is provided on the shaft 83 so as to be able to rotate freely around the shaft 83. The position in the axial direction of the auxiliary roller 87 is matched to the center of the tape T, and, when viewed from the drum axial direction, the auxiliary roller 87 protrudes onto the banknote collection drum 10 side beyond the base component 84. This auxiliary roller 87 which is supported on the shaft 83 is narrower than the width of the tape T so as to be positioned on the inside of the two edge portions of the tape T. As a result of the auxiliary roller 87 being placed against the wind outer circumferential area Tb of the tape T, the auxiliary roller 87 is able to maintain the distance between the wind outer circumferential area Tb and the base component 84. Namely, when a large quantity of only the tape T is wound onto the banknote collection drum 10 and the separation facilitating rollers 85 and 86 do not move in the radial direction of the banknote collection drum 10, this auxiliary roller 87 is in contact with the tape T and causes the base component 84 to move so as to follow the outer radius of the tape T. As a result, the auxiliary roller 87 prevents the base component 84 and the tape T coming into direct contact with each other.

Engaging pins 213 are mounted on the base component 84 side respectively of each of the pair of arm components 81. Engaging pins 214 are mounted in the supporting plate 20 and the side plate 21 on the opposite side respectively from the engaging pins 213 such that they sandwich the banknote collection drum 10. A tension spring (i.e., arm urging component) 91 is interposed between the engaging pins 213 and 214 on each side. These tension springs 91 urge the pair of arm components 81 in a direction in which the pair of separation facilitating rollers 85 and 86 approach the banknote collection drum 10 (i.e., in a clockwise direction in FIG. 2 and FIG. 3).

Engaging pins 215 are mounted respectively in center positions in the pair of arm components 81. Engaging pins 216 are mounted on the base component 84 on the arm component 81 sides thereof and on the opposite side from the shaft 83. A tension spring (i.e., arm urging component) 90 is interposed between the engaging pins 215 and 216 on each side. These tension springs 90 urge the base component 84 in a direction relative to the pair of arm components 81 such that the pair of separation facilitating rollers 85 and 86 approach the banknote collection drum 10 (i.e., in an anticlockwise direction in FIG. 2 and FIG. 3).

The pair of separation facilitating rollers 85 and 86 are placed in contact by the urging force of the tension springs 90 and 91 with the two sides in the transverse direction of the banknote S which is being held on the tape T at a center position in the transverse direction thereof and which is closest to the dispensing side from among the banknotes S which are wound around the banknote collection drum 10. As the position of the banknote S which is closest to the dispensing side changes in the radial direction of the banknote collection drum 10 in accordance with the change in the quantity of banknotes wound around the banknote collection drum 10, mainly the arm components 81 also oscillate so as to follow this change in position. Namely, the banknote separation facilitating mechanism 80 is able to move in the radial direction of the banknote collection drum 10 so as to track the quantity of banknotes which are wound around the banknote collection drum 10. Moreover, the banknote separation facilitating mechanism 80 is in contact with the banknotes S in a boundary position between the intake/discharge area Ta and the wind outer circumferential area Tb of the tape T in the dispensing direction irrespective of the quantity of banknotes.

The banknote S which is being held on the tape T at a center position in the transverse direction thereof and which is closest to the dispensing side from among the banknotes S which are wound around the banknote collection drum 10 moves in conjunction with the dispensing of the tape T. During this movement, in this banknote separation facilitating mechanism 80, the pair of separation facilitating rollers 85 and 86, which are placed on both sides of the tape T and which are inclined such that the gap between them narrows as it approaches the downstream side in the dispensing direction of the banknotes S, push the two sides of the banknotes S towards the tape T. As a result, a crease which extends in the dispensing direction is formed in the banknote S on the tape T side, and the tape T side thereof is lifted away from the wind outer circumferential area Tb of the tape T thereby facilitating separation.

As is shown in FIGS. 1 through 3 and FIG. 6, the banknote separating mechanism 51 has a guide plate 52. The guide plate 52 is directly mounted by means of screws or the like (not shown) on the collection space 23 side of the side plate 21 so as to extend between the shaft 11 and the intake/discharge port 2. This guide plate 52 is formed by a plate component having an L-shaped cross section which is folded back from the side plate 21 onto the collection space 23 side. A pair of guide grooves 53 and 54 which are mutually parallel and which slope downwards as they approach the intake/discharge port 2 side are formed in central positions of the guide plate 52. The upper guide groove 53 is positioned closer to the shaft 11 side than the lower guide groove 54. These guide grooves 53 and 54 are provided on the banknote collection drum 10 side, namely, on the upper side of the intake/discharge area Ta of the tape T.

The banknote separating mechanism 51 has a base component 55. The base component 55 has a sliding pin 62 which is slidably engaged in the guide groove 53 of the guide plate 52, and a sliding pin 63 which is slidably engaged in the guide groove 54 of the guide plate 52. The base component 55 slides between the supporting plate 20 and the slide plate 21 in the direction in which the guide grooves 53 and 54 extend. A slide groove 65 is also formed in the base component 55 so as to extend in parallel with the guide grooves 53 and 54 in the guide plate 52. A guide pin 64 which is mounted on the supporting plate 20 engages in the slide groove 65 so as to be able to slide relatively thereto. This base component 55 is able to perform a stable sliding motion using the guide grooves 53 and 54, the slide groove 65, the sliding pins 62 and 63, and the sliding pin 64.

Overall, the base component 55 is placed on the banknote collection drum 10 side, namely, on the top side of the intake/discharge area Ta of the tape T. The base component 55 has a base portion 218, a base portion 219, and a joining portion 220. The base portion 218 is placed adjacent to the collection space 23 side of the side plate 21, and has the sliding pins 62 and 63 which are engaged in the guide grooves 53 and 54 of the guide plate 52. The base portion 219 is placed adjacent to the collection space 23 side of the supporting plate 20, and has the guide groove 65 which slides while being guided by the guide pin 64 provided on the supporting plate 20. The joining portion 220 joins the base portions 218 and 219 together. When viewed from the drum axial direction, the joining portion 220 is provided so as to protrude onto the intake/discharge area Ta of the tape T at end portions of the base portions 218 and 219 on the opposite side from the banknote collection drum 10.

The banknote separating mechanism 51 has a shaft 69 which is parallel with the banknote collection drum 10 in the portion of the joining portion 220 of the base component 55 which is located inside the base portions 218 and 219 when viewed from the drum axial direction. The banknote separating mechanism 51 has a guide roller 70 which is supported on the shaft 69 so as to be able to rotate freely around this shaft 69. The guide roller 70 protrudes on the banknote collection drum 10 side beyond the joining portion 220. The position of the guide roller 70 in the drum axial direction matches the wind outer circumferential area Tb on the outermost circumference of the tape T which is wound onto the banknote collection drum 10. The above described sliding pins 62 and 63, the guide pin 64, the base component 55, the shaft 69, and the guide roller 70 constitute a sliding portion 222 which slides relative to the banknote collection drum 10.

The banknote separating mechanism 51 has an engaging pin 60, an engaging pin 59, and a tension spring (i.e., an urging component) 57. The engaging pin 60 is mounted on the base portion 219 on the supporting plate 20 side of the base component 55. The engaging pin 59 is mounted at a position on the supporting plate 20 beyond the banknote collection drum 10 on an elongated line extending out from the engaging pin 60 in the direction in which the slide groove 65 extends. The tension spring 57 is interposed between the engaging pins 59 and 60. The banknote separating mechanism 51 has the above described slide pin 62, engaging pin 61, and tension spring (i.e., urging component) 58. The slide pin 62 is mounted on the base portion 218 on the side plate 21 side of the base component 55. The engaging pin 61 is mounted at a position on the side plate 21 beyond the banknote collection drum 10 on an elongated line extending out from the slide pin 62 in the direction in which the guide grooves 53 and 54 extend. The tension spring 58 is interposed between the engaging pin 61 and the slide pin 62.

Accordingly, the base component 55, namely, the sliding portion 222 is urged by the tension springs 57 and 58 in the direction of the center of the banknote collection drum 10. As a result, the sliding portion 222 causes the guide roller 70 which is held on the base component 55 to be placed in contact with the outer circumferential surface of the banknote collection drum 10 when the tape T is not wound around the banknote collection drum 10, and to be placed in contact with the wind outer circumferential area Tb of the tape T when the tape T is wound around the banknote collection drum 10. Accordingly, the sliding portion 222 slides so as to follow the size of the outer circumference which varies depending on the amount of tape T and banknotes S wound onto the banknote collection drum 10. Namely, the guide roller 70 positions the base component 55 relative to the outer circumferential surface of the banknote collection drum 10 and the wind outer circumferential area Tb of the tape T. As a result, the base component 55 slides along the guide grooves 53 and 54 in accordance with the amount of tape T and banknotes S wound onto the banknote collection drum 10. The guide roller 70 is made to rotate as a result of it being in contact with the banknote collection drum 10 or the tape T.

Specifically, when the tape T and banknotes S are not wound onto the banknote collection drum 10, the base component 55 is positioned closest to the side of the shaft 11 the center of the banknote collection drum 10 along the guide grooves 53 and 54 of the guide plate 52. When the tape T and banknotes S are sufficiently wound onto the banknote collection drum 10, the base component 55 is positioned away from the side of the shaft 11 which is substantially the center of the banknote collection drum 10 along the guide grooves 53 and 54 of the guide plate 52. A sensor shielding portion 97 is provided on the base component 55. This sensor shielding portion 97 is detected by an optical collection portion full capacity detection sensor 96 which detects that the amount of banknotes S collected on the banknote collection drum 10 has reached full capacity during the collection operation. Namely, the outer circumference of the banknote collection drum 10 which includes the tape T and banknotes S becomes gradually larger due to the tape T and banknotes S being wound thereon when banknotes are being collected on the banknote collection drum 10. In conjunction with this, the sliding portion 222 of the banknote separating mechanism 51 which includes the sensor shielding portion 97 slides towards the intake/discharge port 2 side which is on the outer side in the radial direction of the banknote collection drum 10. When the collection portion full capacity detection sensor 96 detects this sensor shielding portion 97, it detects that the banknotes S have been collected to full capacity during the operation to collect banknotes on the banknote collection drum 10.

The banknote separating mechanism 51 has a shaft 66 which is parallel with the banknote collection drum 10. The shaft 66 is provided in a portion of the joining portion 220 of the base component 55 which protrudes from the base portions 218 and 219 when viewed from the drum axial direction. The banknote separating mechanism 51 has a separator (i.e., a separating component) 56 which is supported on the shaft 66 so as to be able to oscillate around the shaft 66. Namely, the separator 56 is held in the sliding portion 222 so as to enable oscillation. This separator 56 is located in a space which is substantially in the shape of an acute angle and is formed by the intake/discharge area Ta and the wind outer circumferential area Tb of the tape T which is wound onto the banknote collection drum 10. The separator 56 has a separating distal end portion 224 and a guide portion 225. The separating distal end portion 224 is formed at an end portion on the banknote collection drum 10 side. The guide portion 225 extends from this separating distal end portion 224 along the intake/discharge area Ta of the tape T. The separating distal end portion 224 is shaped as an acute angle when viewed from the drum axial direction, and one of the surfaces thereof is continuous with the guide portion 225.

The banknote separating mechanism 51 also has an engaging pin 227 which is mounted on the separator 56, an engaging pin 228 which is mounted on the base component 55, and a tension spring (i.e., an urging component) 67 which is interposed between the engaging pins 227 and 228. The banknote separating mechanism 51 uses the tension spring 67 to urge the separating distal end portion 224 towards the outer circumferential portion of the banknote collection drum 10 when no tape T has been wound thereon, and, when the tape T has been wound onto the banknote collection drum 10, uses the tension spring 67 to urge the separation distal end portion in a direction in which it comes up against the wind outer circumferential area Tb of the tape T (i.e., in a clockwise direction in FIG. 6). As a result, the separator 56 causes the separating distal end portion 224 to be placed constantly in contact with the wind outer circumferential area when tape T is wound onto the banknote collection drum 10.

Namely, when the tape T is wound onto the banknote collection drum 10 together with the banknotes S, a slight diametrical difference is generated between portions where the banknotes S are present and portions where no banknotes S are present. Because of this, there is also a slight movement in the position of the separator 56 which is held by the sliding portion 222 which is positioned relative to the wind outer circumferential area Tb of the tape T by the guide roller 70 which is placed against the tape T. Because of this, by enabling the separator 56 to oscillate, any diametrical difference is absorbed. The guide roller 70 and the separator 56 have a width which enables them to be contained within the tape T in the drum axial direction.

When banknotes S are being dispensed from the banknote collection drum 10, when the portion of the tape T which was holding the banknotes S reaches the intake/discharge area Ta, there are cases in which the distal end portion of the banknote S which was being held by this portion tries to move while it is still adhered to the wind outer circumferential area Tb of the tape T. In cases such as this, the separating distal end portion 224 of the separator 56 which is positioned against the wind outer circumferential area Tb separates the banknote S by shaving off the distal end portion of the banknote S from the wind outer circumferential portion Tb of the tape T. Moreover, the banknote S which has been separated by the separating distal end portion 224 in this manner is guided to the intake/discharge port 2, namely, towards the downstream side by the guide portion 225 which faces the intake/discharge area Ta of the tape T. As is described above, the separator 56 which actually separates and guides the banknotes S is oscillatingly supported on the base component 55 which slides along the guide grooves 53 and 54 in accordance with the quantity of tape T and banknotes S which are wound onto the banknote collection drum 10.

The guide portion 225 has an intermediate guide surface 230, an intake side guide surface 231 and a dispensing side guide surface 232. The intake side guide surface 231 is positioned on the intake/discharge port 2 side of the intermediate guide surface 230. In a state in which the intermediate guide surface 230 is parallel with the intake/discharge area Ta of the tape T, the intake side guide surface 231 is inclined so as to move away from the intake/discharge area Ta as it approaches the intake/discharge port 2. The dispensing side guide surface 232 is positioned on the banknote collection drum 10 side of the intermediate guide surface 230. In a state in which the intermediate guide surface 230 is parallel with the intake/discharge area Ta of the tape T, the dispensing side guide surface 232 is inclined so as to move away from the intake/discharge area Ta as it approaches the banknote collection drum 10 side. The angle of inclination relative to the intermediate guide surface 230 of the intake side guide surface 231 is greater than that of the dispensing side guide surface 232. The dispensing side guide surface 232 guides banknotes S which have been separated from the banknote collection drum 10 by the separating distal end portion 224 smoothly between the separator 56 and the intake/discharge area Ta of the tape T to the intake/discharge port 2 side. The intake side guide surface 231 is able to guide even banknotes S which are transported from the intake/discharge port 2 side with kinks or folds or curls in them smoothly between the separator 56 and the intake/discharge area Ta of the tape T to the banknote collection drum 10.

The banknote separating mechanism 51 also has a transporting roller 71 which is supported on the shaft 66 which forms the center of oscillation of the separator 56 relative to the base component 55 so as to be able to rotate around this shaft 66.

This transporting roller 71 is always in contact with the guide roller 70. Furthermore, a portion of the transporting roller 71 protrudes from the intermediate guide surface 230 to the intake/discharge area Ta of the tape T side, and is able to make contact with the tape T which is located in this intake/discharge area Ta or with a banknote S mounted on the tape T which is located in this intake/discharge area Ta. As a result, when the banknote collection drum 10 rotates, the transporting roller 71 comes into contact with the guide roller 70 which is made to rotate in the opposite direction by being in contact with the banknote collection drum 10, and the transporting roller 71 is made to rotate in the opposite direction from the guide roller 70. As a result, the transporting roller 71 rotates in the same direction as the banknote collection drum 10. Accordingly, when dispensing banknotes, the transporting roller 71 grips banknotes S which have been separated from the wind outer circumferential area Tb of the tape T on the banknote collection drum 10 between itself and the intake/discharge area Ta of the tape T, and transports them to the intake/discharge port 2 side, namely, to the downstream side.

Figure 8:
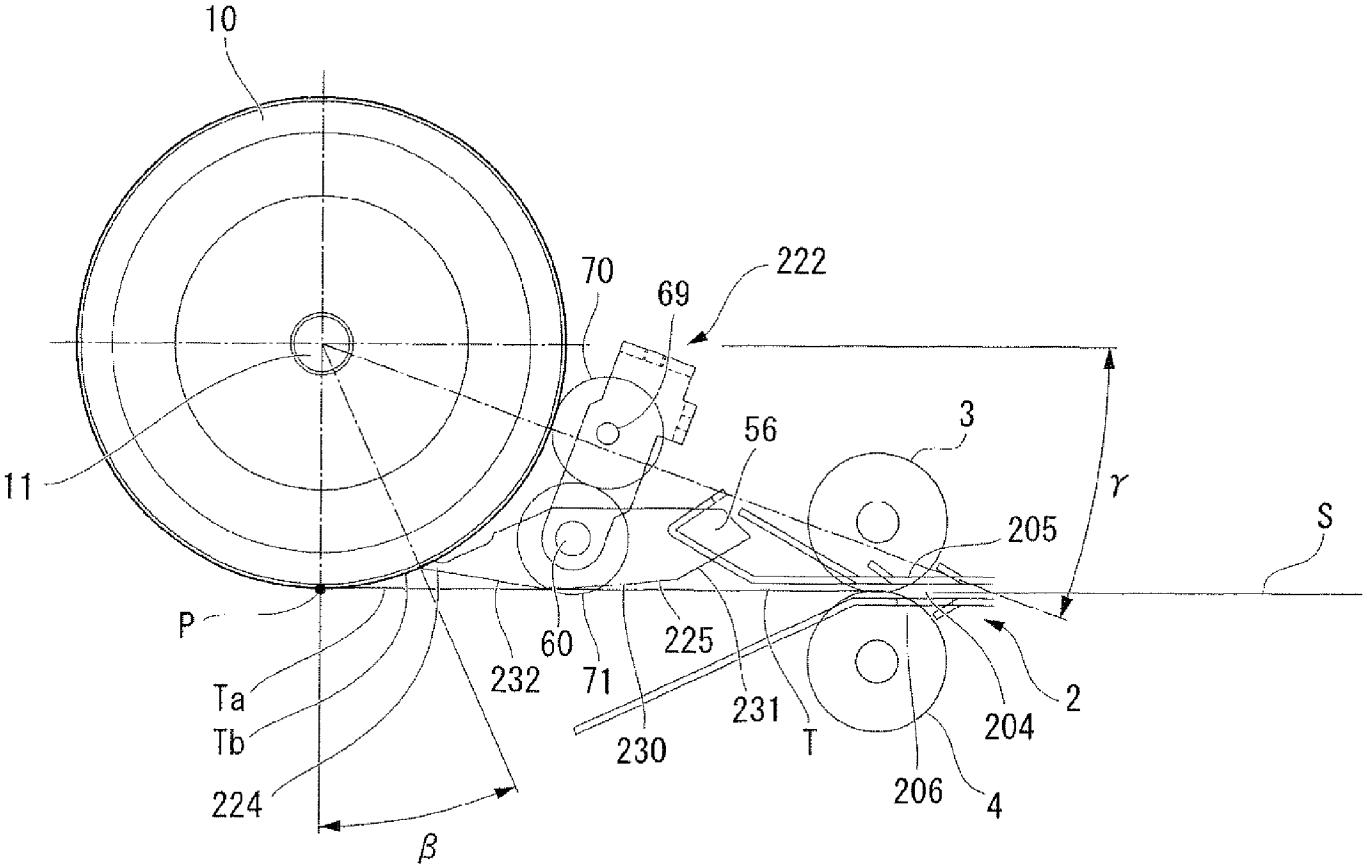
FIG. 8 is a transparent side view showing a side of a banknote collection drum in the sheet paper storage and dispensing device of the embodiment of the present invention, and showing a state in which a tape has been completely unwound from the banknote collection drum side.
Figure 9:
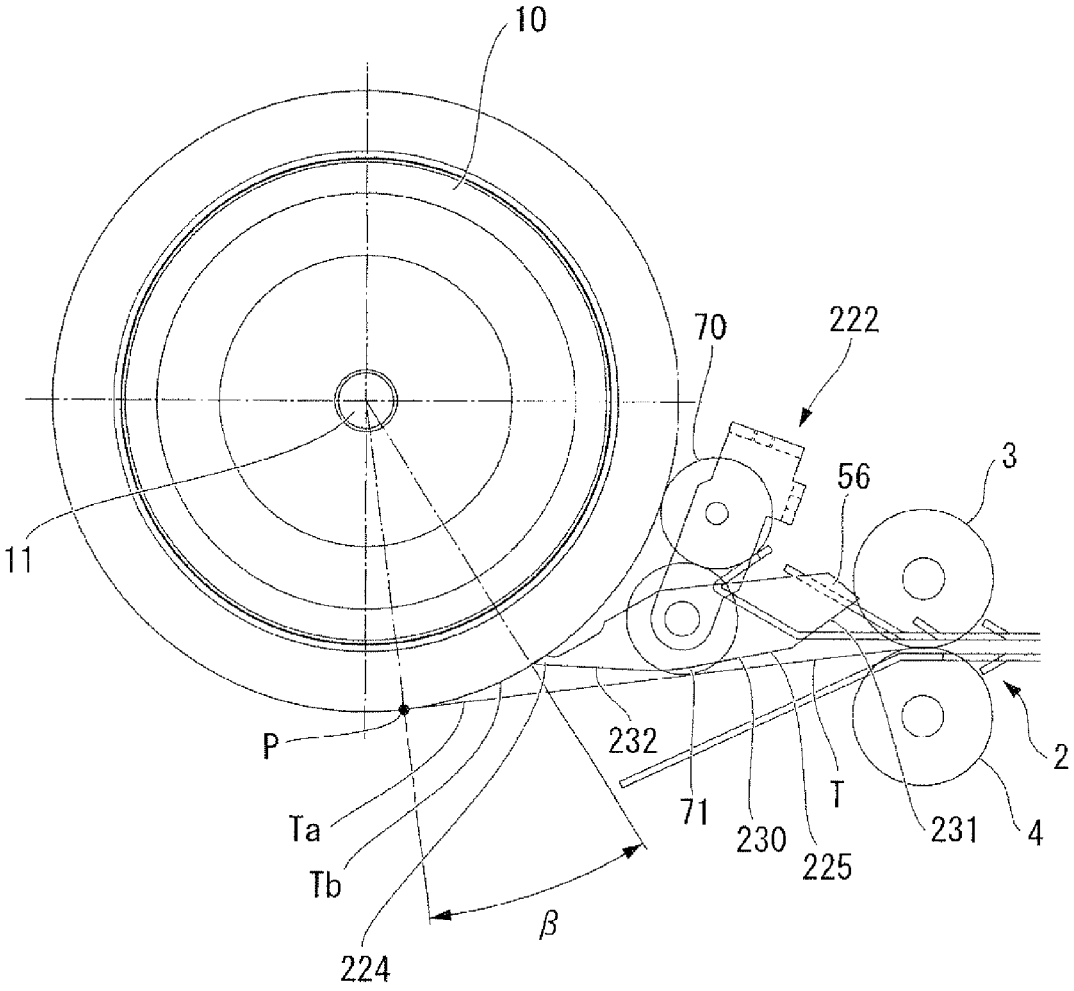
FIG. 9 is a transparent side view showing the side of the banknote collection drum in the sheet paper storage and dispensing device of the embodiment of the present invention, and showing a state in which the tape has been partially wound onto the banknote collection drum side.
Figure 10:
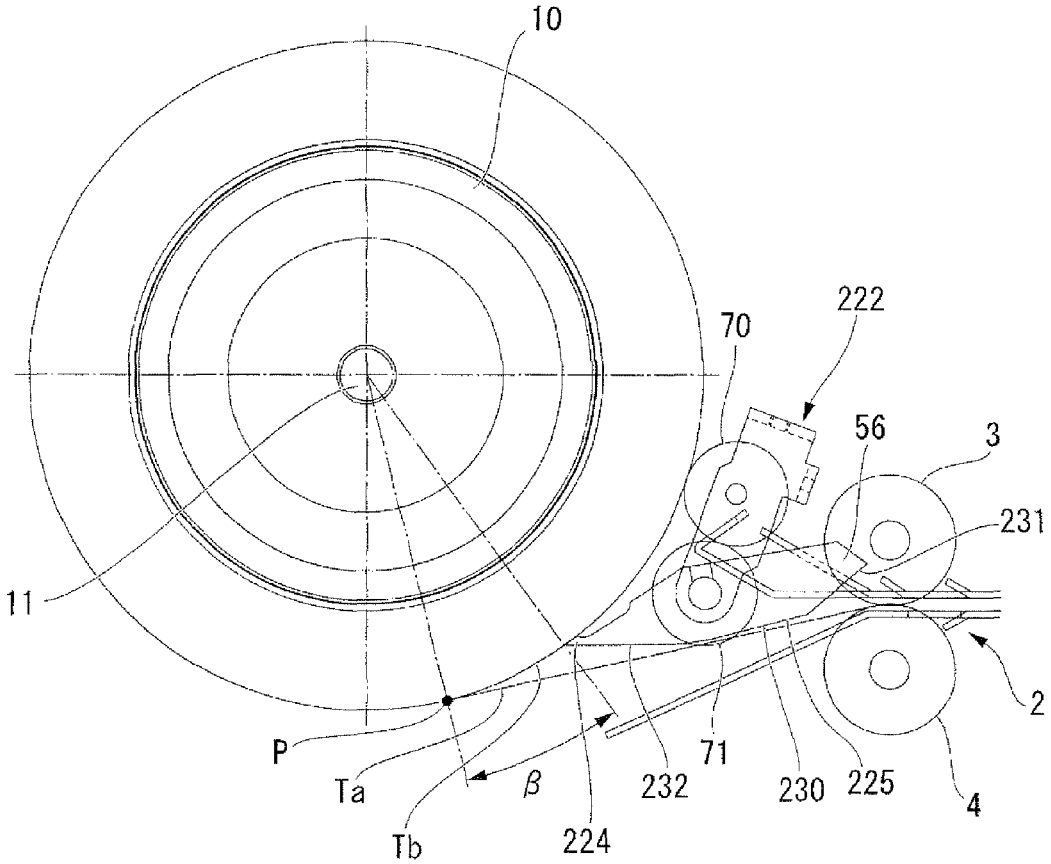
FIG. 10 is a transparent side view showing the side of the banknote collection drum in the sheet paper storage and dispensing device of the embodiment of the present invention, and showing a state in which the tape has been wound to the maximum limit onto the banknote collection drum side.

As is shown in FIG. 8, when the tape T has been dispensed to its maximum possible extent from the banknote collection drum 10, the intake/discharge area Ta of the tape T is superimposed on a line extending out from the intake/discharge port 2. When the tape T and banknotes S are wound onto the banknote collection drum 10, as is shown in FIG. 9 and FIG. 10, in accordance with the quantity of tape T and banknotes S wound on, a dispensing start position P which is the boundary between the intake/discharge area Ta and the wind outer circumferential area Tb of the tape T gradually moves to the intake/discharge port 2 side in the direction of the extended line from the intake/discharge port 2, and at the same time gradually moves away in a radial direction from the banknote collection drum 10. As a result, the intake/discharge area Ta of the tape T is inclined such that the intake/discharge port 2 side thereof is on the upper side. In contrast, the sliding portion 222 which moves along the guide grooves 53 and 54 slides in such a way that the closer to the intake/discharge port 2 side thereof, the lower it is positioned relative to a horizontal line extending out from the intake/discharge port 2. As a result, irrespective of the quantity of tape T and banknotes S which are wound onto the banknote collection drum 10, the sliding portion 222 slides in a direction in which it always intersects the direction in which the tape T is dispensed from the banknote collection drum, 10, namely, in the direction in which the intake/discharge area Ta extends.

Figure 7B:
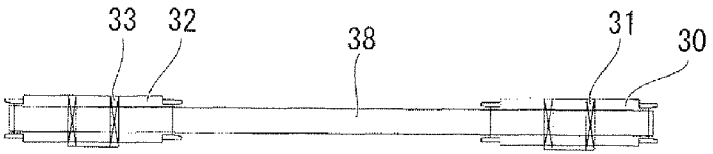
FIG. 7B is a transparent plan view showing the drive system in the sheet paper storage and dispensing device of the embodiment of the present invention.
Figure 7A:
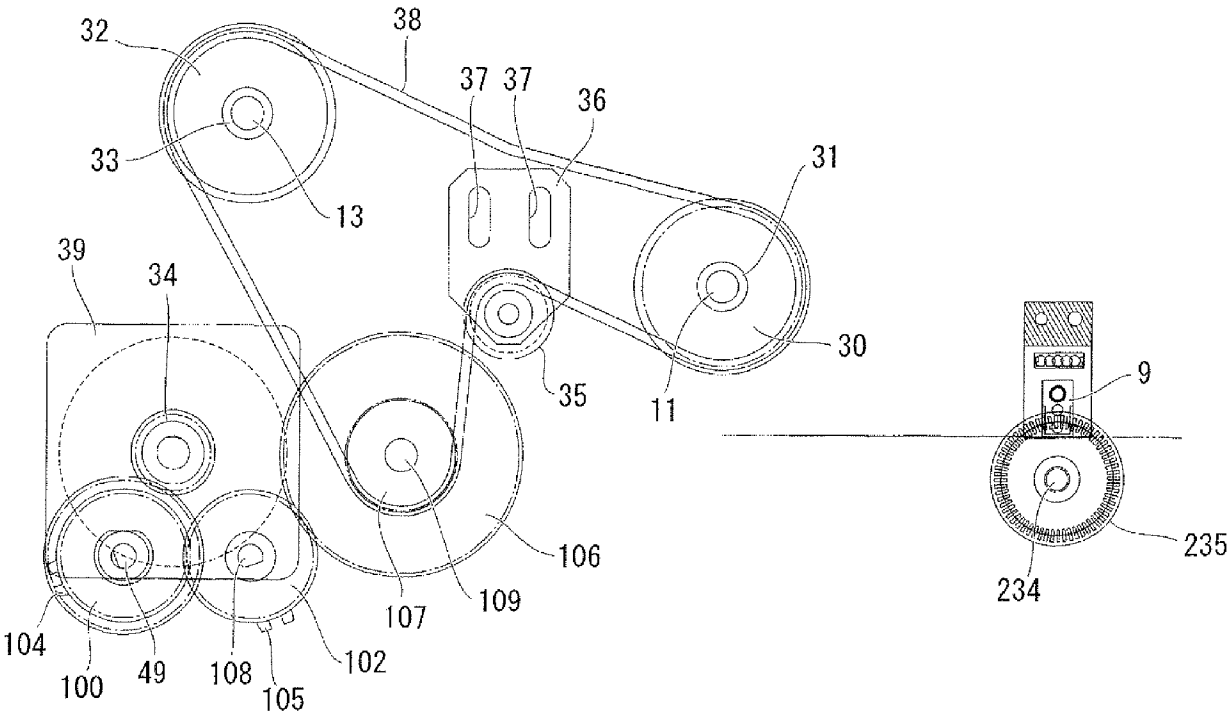
FIG. 7A is a transparent side view showing a drive system in the sheet paper storage and dispensing device of the embodiment of the present invention.

Next, a description will be given of a drive system while referring mainly to FIG. 1 and FIGS. 7A and 7B.

The shaft 11 is rotatably supported by the side plate 19, the supporting plate 20, and the main plate portion 200 of the side plate 21 so as to be orthogonal to these. A torque limiter 17 which is mounted on the supporting plate 20 via a mounting plate 18 is inserted through the shaft 11. An engaging component 16 which engages with the torque limiter 17 is fixed to the shaft 11. Namely, the torque limiter 17 is provided between the engaging component 16 which is fixed to the shaft 11 and the mounting plate 18 which is a non-rotating portion. The torque limiter 17 and the engaging component 16 are placed within one recessed portion 15 of the banknote collection drum 10.

A torque limiter 110 which is inserted through the shaft 11 is mounted in the other recessed portion 15 in the banknote collection drum 10. An engaging component 111 which engages with the torque limiter 110 is fixed to the shaft 11 while being placed within the recessed portion 15.

The torque limiter 17 only allows the shaft 11 to rotate when it receives rotation torque from a motor 39 when banknotes are being stored, or when it receives rotation torque caused by tension in the tape T which is created by the tape wind-on drum 12 being wound when banknotes are being dispensed. Namely, the torque limiter 17 does not allow the shaft 11 to rotate except when it is necessary when banknotes are being stored or dispensed. The torque limiter 110 generates slippage between the shaft 11 and the banknote collection drum 10 when the outer diameters of the banknote collection drum 10 and the tape wind-on drum 12 differ considerably and the difference between the rotation speeds of each increases because of the tape T and banknotes S being wound on, and thereby absorbs the differences in the speed of each. As a result, it is possible to absorb any rotation speed differences caused by changes in the outer diameters without performing any special gear conversion or the like. The tension in the tape T can thus be made constant and, at the same time, it becomes difficult for any excessive shock to act on the tape T even when an abrupt shock such as a banknote jam or the like occurs.

The shaft 13 is rotatably supported by the side plate 19, the supporting plate 20, and the step plate portion 201 of the side plate 21 so as to be orthogonal to these. A torque limiter 27 which is mounted on the supporting plate 20 via a mounting plate 28 is inserted through the shaft 13. An engaging component 26 which engages with the torque limiter 27 is fixed to the shaft 13. Namely, the torque limiter 27 is provided between the engaging component 26 which is fixed to the shaft 13 and the mounting plate 28 which is a non-rotating portion.

A torque limiter 120 which is inserted through the shaft 13 is mounted via a mounting plate 122 on the tape wind-on drum 12 which is supported on the shaft 13. An engaging component 121 which engages with the torque limiter 120 is fixed to the shaft 13.

The torque limiter 27 only allows the shaft 13 to rotate when it receives rotation torque from the motor 39 when banknotes are being dispensed, or when it receives rotation torque caused by tension in the tape T which is created by the banknote collection drum 10 being wound when banknotes are being stored. Namely, the torque limiter 27 does not allow the shaft 13 to rotate except when it is necessary when banknotes are being stored or dispensed. The torque limiter 120 generates slippage between the shaft 13 and the tape wind-on drum 12 when the outer diameters of the tape wind-on drum 12 and the banknote collection drum 10 differ considerably and the difference between the rotation speeds of each increases because of the tape T and banknotes S being wound on, and thereby absorbs the differences in the speed of each. As a result, it is possible to absorb any rotation speed differences caused by changes in the outer diameters without performing any special gear conversion or the like. The tension in the tape T can thus be made constant and, at the same time, it becomes difficult for any excessive shock to act on the tape T even when an abrupt shock such as a banknote jam or the like occurs.

A shaft 109 is rotatably supported by the side plate 19, the supporting plate 20, and the step plate portion 201 of the side plate 21 so as to be orthogonal to these. Shafts 49 and 108 are supported on the supporting plate 20 so as to be orthogonal to it. The shaft 49 is able to rotate relative to the supporting plate 20, while the shaft 108 is fixed to the supporting plate 20.

A gear 103 is fixed to a portion on the collection space 23 side of the shaft 49. This gear 103 meshes with a gear 34 of the motor 39 which is also placed on the same collection space 23 side. An electromagnetic clutch 100 is mounted on a portion on the drive system space 22 side of the shaft 49. A gear 104 is provided via this electromagnetic clutch 100 on the shaft 49. Namely, drive force from the motor 39 is transmitted to the electromagnetic clutch 100 via the gears 34 and 103 and the shaft 49. When the electromagnetic clutch 100 is engaged (that is, when the electromagnetic clutch 100 is put into the on state), the shaft 49 rotates integrally with the gear 104, while when the electromagnetic clutch 100 is disengaged (that is, when the electromagnetic clutch 100 is put in the off state), the shaft 49 idles freely in a state of disengagement from the gear 104.

A gear 105 is provided on a portion on the drive system space 22 side of the fixed shaft 108 via an electromagnetic brake 102. This gear 105 meshes with the gear 104. When this electromagnetic brake 102 is disengaged (that is, when the electromagnetic brake 102 is put into the off state), the gear 105 is in a free idling state, while when the electromagnetic brake 102 is engaged (that is, when the electromagnetic brake 102 is put into the on state), the gear 105 is fixed to the fixed shaft 108, and a brake can be applied thereto so as to stop it instantly.

A gear 106 which meshes with the gear 105 is fixed to a portion on the drive system space 22 side of the shaft 109, and a gear 107 is also fixed to the shaft 109. A manually operated handle pulley 112 is fixed to a portion of the shaft 109 on the outer side of the step plate portion 201.

A toothed pulley 30 is rotatably provided via a one-way clutch 31 on a portion on the drive system space 22 side of the shaft 11. A toothed pulley 32 is also rotatably provided via a one-way clutch 33 on a portion on the drive system space 22 side of the shaft 13 as well. A toothed timing belt 38 is looped over the toothed pulleys 30 and 32.

When driving force in a winding direction which causes the tape T to rotate in a wind-on direction when the toothed pulley 30, the shaft 11, and the banknote collection drum 10 rotate integrally is applied to the toothed pulley 30 by the timing belt 38, the one-way clutch 31 is placed in a locked state which causes the shaft 11 to rotate integrally with the toothed pulley 30. In contrast, when driving force in a dispensing direction which causes the tape T to rotate in a dispensing direction when the toothed pulley 30, the shaft 11, and the banknote collection drum 10 rotate integrally is applied to the toothed pulley 30, the one-way clutch 31 places the shaft 11 in a free state relative to the toothed pulley 30.

When driving force in a winding direction which causes the tape T to rotate in a wind-on direction when the toothed pulley 32, the shaft 13, and the tape wind-on drum 12 rotate integrally is applied to the toothed pulley 32 by the timing belt 38, the one-way clutch 33 is placed in a locked state which causes the shaft 13 to rotate integrally with the toothed pulley 32. In contrast, when driving force in a dispensing direction which causes the tape T to rotate in a dispensing direction when the toothed pulley 32, the shaft 13, and the tape wind-on drum 12 rotate integrally is applied to the toothed pulley 32, the one-way clutch 33 places the shaft 13 in a free state relative to the toothed pulley 32.

The timing belt 38 is also looped over a pulley 35 which imparts tension to the timing belt 38. A supporting component 36 is mounted on the supporting plate 20 and supports the pulley 35 while allowing it to rotate. Two elongated mounting holes 37 are provided in this supporting component 36. By adjusting the mounting position of the supporting component 36 relative to the supporting plate 20 within the range of the mounting holes 37, it becomes possible to adjust the tension of the timing belt 38.

As is shown in FIG. 2, collection sheet paper sensors 40*a* and 40*b* are positioned such that the sensor optical paths thereof pass through the sensor optical path groove 14 which is provided in the banknote collection drum 10. Remainder detection is performed by these collection sheet paper detection sensors 40*a* and 40*b* in which whether or not banknotes S remain collected on (i.e., wound onto) the banknote collection drum 10 is detected. The reason why the two collection sheet paper sensors 40*a* and 40*b* are provided is because, due to the fact that the outer circumferential length of the banknote collection drum 10 is greater than the length of the long side of the smallest banknote S, if only one collection sheet paper sensor is provided, there is a possibility when the banknote collection drum 10 is stopped that it will not be possible to completely detect the presence of banknotes S which have been wound onto the banknote collection drum 10. Accordingly, if the outer circumferential length of the banknote collection drum 10 is less than the length of the long side of the smallest banknote S, then it becomes possible to completely detect the presence of banknotes S using one collection sheet paper sensor. If control is performed such that the banknote collection drum 10 is slightly rotated and a broad range of the outer circumferential surface is placed on the sensor optical path, then it becomes possible to completely detect the presence of banknotes S using one collection sheet paper sensor.

An optical passage verification sensor 41 (i.e., a trigger sensor) which detects the passage of banknotes S by means of light shielding is provided directly outside the top roller 3 and bottom roller 4 in the intake/discharge port 2. This passage verification sensor 41 detects the feeding in of banknotes S from the transporting path 50 to the intake/discharge port 2 and the feeding out of banknotes S from the intake/discharge port 2 to the transporting path 50. The passage verification sensor 41 also counts the number of banknotes S stored and dispensed, and also detects the timing for controlling the respective electromagnetic clutches 100 and 102.

An optical first end detection sensor (i.e., a dispensing end detection section) 95 is provided between the bottom roller 4 and the banknote collection drum 10. The first end detection sensor 95 detects that the tape T which is being dispensed from the banknote collection drum. 10 has reached the end, namely, detects that the dispensing of the tape T from the banknote collection drum 10 has ended by detecting a detection portion (not shown) which is formed on the tape T. When the tape T is formed having a semitransparent resin material as its main component, for example, the detection portion may be formed on the tape T by creating either all or part of this detection portion as a non-transparent colored portion or the like. It is also possible to provide various detection portions in locations such as the end of the tape T which is being dispensed from the banknote collection drum 10, a point near this end, the end of the tape T which is being dispensed from the tape wind-on drum 12, and a point near this end.

A tape end detection section 44 is provided in the vicinity of the tape wind-on drum 12. The tape end detection section 44 detects that the end of the tape T which is being dispensed from the tape wind-on drum 12 has been reached. This tape end detection section 44 has a shaft 43, a tape end detection arm 45, a roller 46, a tension spring 48, and a second end detection sensor 42. The shaft 43 is placed parallel with the shaft 13 in the vicinity of the tape wind-on drum 12. The tape detection arm 45 is provided so as to be able to oscillate around the shaft 43. The roller 46 is provided parallel with the shaft 43 at the end portion on the opposite side of the tape end detection arm 45 from the shaft 43. The tension spring 48 urges the tape end detection arm 45 in a direction in which the roller 46 is brought into contact with the outermost circumferential surface of the tape T which is wound onto the tape wind-on drum 12 (i.e., in an anticlockwise direction in FIGS. 2 and 3). The second end detection sensor 42 is an optical sensor which detects a sensor shielding portion 47 formed on the tape end detection arm 45 when the tape T is dispensed from the tape wind-on drum 12 to a point near its end.

Specifically, the tape T which was wound onto the tape wind-on drum 12 is dispensed as the banknote S storage operation proceeds, and the diameter of the outermost circumference of the tape T which is wound onto the tape wind-on drum 12 becomes gradually smaller. At this time, the tape end detection arm 45 which is pressing the roller 46 against this outermost circumference is made to gradually swing around the shaft 43 by the spring force of the tension spring 48 so as to track the outermost circumference. When the sensor shielding portion 47 of the tape end detection arm 45 shields the optical path of the second end detection sensor 42, the second end detection sensor 42 detects that the tape T has been dispensed from the tape wind-on drum 12 nearly to its end.

Instead of using the tape end detection section 44, it is also possible to detect that the tape T has been dispensed from the tape wind-on drum 12 nearly to its end using the above-described collection portion full capacity detection sensor 96 and the sensor shielding portion 97 provided on the base component 55 of the banknote separating mechanism 51. Namely, when the sensor shielding portion 97 of the base component 55 moves beyond a particular predetermined position, it is determined that the tape T has been dispensed until it is near its end. The collection portion full capacity detection sensor 96 corresponds to a position on the outer circumferential portion of the banknote collection drum 10 onto which both the tape T and banknotes S have been wound and which includes these. Because of this, if banknotes S are not being collected and only the tape T has been wound onto the banknote collection drum 10, there is a possibility that all of the tape T will be dispensed from the tape wind-on drum 12 before the sensor shielding portion 97 is detected by the collection portion full capacity detection sensor 96. In cases such as this, it is necessary to provide a sensor to detect the sensor shielding portion 97 at a position where a point near the end of the tape T can be detected when banknotes S are not being collected and only the tape T has been wound onto the banknote collection drum 10, and to detect that the tape T has been dispensed until it is near its end when this position has been exceeded. In this case as well, it is necessary for this sensor to be used in combination with the first end detection sensor 95.

Specifically, in the present embodiment, non-transparent detection portions are provided respectively on the transparent tape T such that the end portion on the banknote collection drum 10 side of the tape T and the end portion on the tape wind-on drum 12 side of the tape T are able to be detected by the first end detection sensor 95. When the detection portion used for detecting the end portion on the tape wind-on drum 12 side is detected by the first end detection sensor 95, and the second end detection sensor 42 of the tape end detection section 44 has detected the sensor shielding portion 47, it is recognized that the tape T has reached its end portion relative to the tape wind-on drum 12. In contrast, when the detection portion used for detecting the end portion on the banknote collection drum 10 side is detected by the first end detection sensor 95, and the second end detection sensor 42 of the tape end detection section 44 has not detected the sensor shielding portion 47, it is recognized that the tape T has reached its end portion relative to the banknote collection drum 10.

Normally, each time a banknote S storage command is issued, banknotes S are collected on the banknote collection drum 10. At this time, this full capacity detection for the banknote collection drum 10 is controlled by ascertaining the number of banknotes collected using an upper phase control unit (i.e., a motor speed variable control unit, a winding control unit, and an unwinding control unit) C shown in FIG. 2. If some unforeseen circumstance occurs or the like which causes full capacity of the banknote collection drum 10 to be detected by the collection portion full capacity detection sensor 96, or when an end of the tape T is detected by the first end detection sensor 95 and second end detection sensor 42 of the tape T, an emergency stop is implemented on the banknote collection drum 10.

A rotation revolution detection plate (i.e., a tape speed detection section) 235 is fixed to a supporting shaft 234 of the bottom roller 4. The number of revolutions of this revolution speed detection plate 235, namely, the number of revolutions of the bottom roller 4 is detected by a revolution number detection sensor (i.e., a tape speed detection section) 9 which is located adjacently to the rotation revolution detection plate 235. The control unit C calculates the transporting speed of the tape T at the intake/discharge port 2, namely, the transporting speed of the banknotes S by the tape T based on the number of revolutions speed per unit time of the bottom roller 4 which is detected by the revolution number detection sensor 9 located on the bottom roller 4. When a winding operation is being performed in order to store banknotes S on the banknote collection drum 10, the control unit C controls the number of revolutions of the motor 39 such that the number of revolutions (i.e., the transporting speed of the tape T, namely, of the banknotes S) detected by the revolution number detection sensor 9 is held at a predetermined fixed value for the winding operation. Moreover, when an unwinding operation is being performed in order to dispense banknotes S from the banknote collection drum 10, the control unit C controls the number of revolutions of the motor 39 such that the number of revolutions (i.e., the transporting speed of the tape T, namely, of the banknotes S) detected by the revolution number detection sensor 9 is held at a predetermined fixed value for the unwinding operation. The motor 39 may be a pulse motor capable of forward and reverse rotation. As a result of control to set the pulse number of a motor control IC which is built into a D/A converter being performed by the control unit C, the rotation speed of the motor 39 is held at an arbitrary uniform speed which corresponds to this pulse number, and the motor 39 can be altered to an arbitrary speed to correspond to this pulse number if the settings are changed.

When banknotes S are being stored, if the electromagnetic clutch 100 of the shaft 49 is engaged (that is, the electromagnetic clutch 100 is put into the on state) and the electromagnetic brake 102 of the shaft 108 is disengaged (that is, the electromagnetic brake 102 is put into the off state) and the motor 39 is rotated in a banknote storage direction, rotation force from the motor 39 imparts rotation in the banknote storage direction (i.e., in a clockwise direction in FIGS. 2 and 3) to the shaft 11 via the timing belt 38. As a result, the banknote collection drum 10 is rotated in the banknote storage direction (i.e., in a clockwise direction in FIGS. 2 and 3) via the torque limiter 17, and the tape T and banknotes S are wound on. At this time, the tape wind-on drum 12 and the shaft 13 are also made to rotate via the tape T.

At this time, the outer diameter of the banknote collection drum 10 becomes gradually larger as the tape T and banknotes S are wound on. In contrast, the outer diameter of the tape wind-on drum 12 becomes gradually smaller as the tape T is dispensed therefrom. In this manner, because the difference between the outer diameters of the banknote collection drum 10 and the tape wind-on drum 12 increases thereby causing the difference between the rotation speeds of each to increase, in some cases, there is a possibility of accidents occurring such as gear-tooth skipping and the like. However, these differences are absorbed by the action of the torque limiter 120 which is provided between the shaft 13 and the tape wind-on drum 12.

When the winding by this banknote collection drum 10 has ended, namely, when it is detected by the passage verification sensor 41 that the number of banknotes needing to be stored have been stored, the electromagnetic clutch 100 of the shaft 49 is disengaged, and the drive force from the motor 39 is interrupted. In conjunction with this, the electromagnetic brake 102 of the shaft 108 is engaged so that a brake is applied to the timing belt 38, and the shaft 11 and banknote collection drum 10 are stopped by the torque limiter 17 provided between the banknote collection drum 10 and the supporting plate 20. As a result, the tape wind-on drum 12 which is idling freely via the tape T is stopped by the torque limiter 27 provided between the tape wind-on drum 12 and the supporting plate 20. In this way, the electromagnetic clutch 100 switches between transmitting and interrupting the drive force arriving via the drive system from the motor 39, and the electromagnetic brake 102 applies sufficient braking to the drive system to stop the banknote collection drum 10.

In contrast, when banknotes S are being dispensed, if the electromagnetic clutch 100 of the shaft 49 is engaged (that is, the electromagnetic clutch 100 is put into the on state) and the electromagnetic brake 102 of the shaft 108 is disengaged (that is, the electromagnetic brake 102 is put into the off state) and the motor 39 is rotated in a banknote dispensing direction, rotation force from the motor 39 imparts rotation in the banknote dispensing direction (i.e., in an anticlockwise direction in FIGS. 2 and 3) to the shaft 13 via the timing belt 38. As a result, the tape wind-on drum 12 is rotated in the banknote dispensing direction (i.e., in an anticlockwise direction in FIGS. 2 and 3) via the torque limiter 27, and the tape T is wound on. At this time, the banknote collection drum 10 and the shaft 11 are also allowed to idle freely via the tape T.

At this time, the outer diameter of the tape wind-on drum 12 becomes gradually larger as the tape T is wound on. In contrast, the outer diameter of the banknote collection drum 10 becomes gradually smaller as the tape T and banknotes S are dispensed therefrom. In this manner, because the difference between the outer diameters of the banknote collection drum 10 and the tape wind-on drum 12 increases thereby causing the difference between the rotation speeds of each to increase, in some cases, there is a possibility of accidents occurring such as gear-tooth skipping and the like. However, these differences are absorbed by the action of the torque limiter 110 which is provided between the shaft 11 and the banknote collection drum 10.

When the winding by this tape wind-on drum 12 has ended, namely, when it is detected by the passage verification sensor 41 that the number of banknotes S needing to be dispensed have been dispensed, the electromagnetic clutch 100 of the shaft 49 is disengaged, and the drive force from the motor 39 is interrupted. In conjunction with this, the electromagnetic brake 102 of the shaft 108 is engaged so that a brake is applied to the timing belt 38, and the shaft 13 and tape wind-on drum 12 are stopped by the torque limiter 27 provided between the tape wind-on drum 12 and the supporting plate 20. As a result, the banknote collection drum 10 which is rotating in an idling state via the tape T is stopped by the torque limiter 17 provided between the banknote collection drum 10 and the supporting plate 20. At this time, the collection banknote detection sensors 40*a* and 40*b* report to the control unit C that there are no banknotes left on the banknote collection drum 10. In this way, the electromagnetic brake 102 applies sufficient braking to the drive system to stop the tape wind-on drum 12.

The sheet paper storage and dispensing device 1 of the present embodiment which has the above described structure may be used, for example, as a temporary holding section in an automated teller machine. In this case, this sheet paper storage and dispensing device 1 operates in the following manner.

The sheet paper storage and dispensing device 1 which is used as a temporary holding section in an automated teller machine stores various mixed denomination banknotes which have been loaded into the automated teller machine by an operator until it receives a deposit confirmation command.

When a depositing operation such as loading the banknotes S has been completed by an operator and an operation to start counting (such as by pressing a button) has begun, the control unit C causes the loaded banknotes S to be taken into the main body of the machine, and issues an operating command to a transporting system which includes the transporting path 50 causing the banknotes to be classified, counted, and temporarily stored, and causing any defective banknotes to be rejected. At the same time as this, the control unit C issues a drive command to the motor 39 of the sheet paper storage and dispensing device 1 commanding it to rotate in the direction in which it stores the banknotes, and thus causes the motor 39 to rotate. At this time, because the electromagnetic clutch 100 and the electromagnetic brake 102 are disengaged, the drive is not transmitted to the shaft 11 and the shaft 13, and the drive from the motor 39 is only causing the gear 103 of the shaft 49 to spin idly while disengaged.

Thereafter, when it is detected as a result of the passage verification sensor 41 of the intake/discharge port 2 becoming shaded that the temporarily stored banknotes have been taken into the intake/discharge port 2 from the transporting path 50, the control unit C engages the electromagnetic clutch 100 and thereby the drive from the motor 39 is transmitted to the shaft 11. As a result, the winding operation by the banknote collection drum 10 is started, and the drive force from the motor 39 is transmitted via the timing belt 38 to the shaft 11 so that the banknote collection drum 10 is made to rotate in the banknote collection direction (i.e., in a clockwise direction in FIGS. 2 and 3). In this manner, the tape T is sequentially dispensed from the tape wind-on drum 12 and wound onto the banknote collection drum 10. At this time, the banknote S which have been supplied one-by-one and separately from each other from the intake/discharge port 2 and are to be held temporarily are superimposed on the intake/discharge area Ta of the tape T by the bottom roller 3 and top roller 4, and are then wound onto the banknote collection drum 10 together with the tape T. Moreover, at this time, the banknotes S which have entered via the intake/discharge port 2 are guided by the intake side guide surface 231 of the guide portion 225 of the separator 56, and are smoothly taken in between the separator 56 and the intake/discharge area Ta of the tape T. The banknotes S then receive transporting force in the direction of the banknote collection drum 10 from the transporting roller 71 which is being made to rotate via the guide roller 70 in conjunction with the rotation of the banknote collection drum 10, which cause them to be wound onto the banknote collection drum 10. During this winding operation, the control unit C controls the rotation speed of the motor 39 in such a way that the transporting speed of the tape T at the intake/discharge port 2 which is detected by the revolution number detection sensor 9 is held at a fixed speed which is faster by a predetermined amount (for example, 5%) than the fixed transporting speed of the banknotes S on the transporting path 50.

At the point in time when the rear end portion of a banknote S whose distal end side has been wound onto the banknote collection drum 10 passes the passage verification sensor 41, or at the point in time when a predetermined time required for the banknote S to be stored has elapsed after the point in time when the distal end portion of the banknote S taken in via the intake/discharge port 2 has been detected by the passage verification sensor 41, the control unit C disengages the electromagnetic clutch 100. In conjunction with this, the control unit C engages the electromagnetic brake 102 so that the drive from the motor 39 is no longer transmitted to the shaft 11 and brake force is applied to the timing belt 38. Consequently, the rotation of the shaft 11 is immediately stopped by the action of the torque limiter 17. Each time the banknotes S which are to be held temporarily are detected by the passage verification sensor 41 in the intake/discharge port 2, the control unit C repeats the above described winding operation.

When all of the deposited banknotes S have been stored in the sheet paper storage and dispensing device 1, or have been returned to the operator as reject banknotes, the control unit C displays the total sum of the banknotes being temporarily held on a display unit (not shown). At the same time as the total sum is displayed, the operator is urged to perform the next processing operation, namely, to confirm or cancel the deposit of the temporarily held banknotes. If the operator confirms the deposit, an operation to confirm the deposit is performed, while if the operator cancels the deposit, an operation to cancel the deposit is performed. In accordance with this, the control unit C issues commands to the respective locations in order that the respective processings are started. Namely, in the transporting system of each section of an automated teller machine, driving which includes transporting in the opposite direction on the conveyor 50 is performed, and a command to drive in the banknote dispensing direction is issued to the motor 39 thereby causing the motor 39 to rotate. The electromagnetic clutch 100 is then engaged and the drive force of the motor 39 is transmitted to the shaft 13 causing an unwinding operation to start.

Consequently, the drive force of the motor 39 is transmitted via the timing belt 38 to the shaft 13, and the tape wind-on drum 12 is rotated in the banknote dispensing direction (i.e., in an anticlockwise direction in FIGS. 2 and 3). As a result, the tape T and banknotes S are sequentially dispensed from the banknote collection drum 10 and the tape T alone is wound onto the tape wind-on drum 12. At this time, as a result of the action of the banknote separation facilitating mechanism 80, a crease extending in the banknote transporting direction can be formed on the tape T side of the banknotes S which are being dispensed from the banknote collection drum 10. In this manner, the separating distal end portion 224 of the separator 56 of the banknote separating mechanism 51 enters the creased portion of the banknotes S whose separation from the banknote collection drum 10 has been thus facilitated. As a result, the banknotes S are reliably separated from the wind outer circumferential area Tb of the tape T which was wound onto the banknote collection drum 10, and are transported to the intake/discharge port 2 while being guided by the dispensing side guide surface 232 of the guide section 225 of the separator 56 between itself and the intake/discharge area Ta of the tape T. At this time, transporting force towards the intake/discharge port 2 side is imparted to the banknotes S from the transporting roller 71 which is being made to rotate via the guide roller 70 in conjunction with the rotation of the banknote collection drum 10.

In this manner, the banknotes S which were stored on the banknote collection drum 10 are dispensed from the intake/discharge port 2, and are delivered to the transporting path 50, and only the tape T is wound onto the tape wind-on drum 12. During this unwinding operation, the control unit C controls the rotation speed of the motor 39 in such a way that the transporting speed of the tape T at the intake/discharge port 2 which is detected by the revolution number detection sensor 9 is held at a fixed speed which is slower by a predetermined amount (for example, 5%) than the fixed transporting speed of the banknotes on the transporting path 50.

In the case of a deposit confirmation operation, the banknotes S once again pass through a classifying section or the like (not shown) where the banknote denomination is confirmed, and are then transported to a different storage section depending on their denomination. In the case of a cancel operation, the banknotes S are transported to the money out port of the automated teller machine.

During an unwinding operation, when the end of the tape T on the banknote collection drum 10 side is detected, namely, when it is detected that the dispensing of the tape T has ended by the first end detection sensor 95 and the second end detection sensor 42, the control unit C disengages the electromagnetic clutch 100 and engages the electromagnetic brake 102 so that the drive force of the motor 39 is not transmitted to the shaft 13, namely, to the tape wind-on drum 12. As a result, the rotation of the shaft 13, namely, of the tape wind-on drum 12 is rapidly brought to a halt by the action of the torque limiter 27.

Even if a sudden temporary change in voltage or a jam in the banknotes S or a blockage of the tape T or a breakage of the tape T or the like occurs during the above described winding operation or unwinding operation, it is possible to instantly detect an abnormality in the speed of the tape T by means of the revolution number detection sensor 9. Accordingly, when an abnormality is detected, it is possible to rapidly stop the winding operation or unwinding operation currently being executed.

According to the above described sheet paper storage and dispensing device 1 of the present embodiment, the transporting speed of the tape T at the intake/discharge port 2 is detected by the revolution number detection plate 235 and the revolution number detection sensor 9. Because of this, compared with when the transporting speed of the tape is calculated artificially from the diameter of the outer circumference and the like of the tape which is wound onto a drum and which changes depending on the number of winds around the drum of the tape or on the number of banknotes stored on the drum, the transporting speed of the tape T can be measured easily and accurately.

Moreover, during a winding operation which starts when the feeding of banknotes S to the intake/discharge port 2 is detected by the passage conformation sensor 41, the control unit C controls the motor 39 in such a way that the transporting speed of the tape T which is detected by the revolution number detection plate 235 and the revolution number detection sensor 9 is held at a fixed speed which is faster by a predetermined amount (for example, 5%) than the transporting speed of the external transporting path 50. Because of this, it is possible to safely draw banknotes S which have been fed from the conveyor 50 into the interior through the intake/discharge port 2. Namely, when banknotes S are being transferred, the fact the transporting speed of the recipient side is slightly faster than the transporting speed of the transferring side makes it possible to perform a transfer with stability.

Moreover, the control unit C controls the rotation speed of the motor 39 in such a way that the transporting speed of the tape T which is detected by the revolution number detection plate 235 and the revolution number detection sensor 9 is held at a fixed speed which is slower by a predetermined amount (for example, 5%) than the transporting speed of the external transporting path 50. Because of this, the banknotes which are dispensed to the transporting path 50 can be transferred safely onto the transporting path 50.

Moreover, the revolution number detection plate 235 and the revolution number detection sensor 9 are placed on the bottom roller 4 which is a feed roller provided in the intake/discharge port 2 and which laminates together the tape T and banknotes S. Because of this, placement of the revolution number detection plate 235 and the revolution number detection sensor 9 can be performed easily, and it is possible to easily and accurately measure the transporting speed of the tape T. It is also possible for the material used for the outer circumferential surface, namely, for at least a portion of the bottom roller 4 to be a material having a high coefficient of friction such as urethane rubber or the like. If this type of structure is employed, then even if speed variations such as a rapid increase in speed or a rapid decrease in speed occur in the tape T which is being transported by being in contact with the bottom roller 4, it is possible to inhibit any slippage of the bottom roller 4 relative to the tape T and restrict any speed discrepancies between these two, and it is possible to make the transporting of the tape T even more stable.

Each time a winding operation or an unwinding operation is performed on the tape T, it is also possible using the control unit C to count the pulse number of the driving of the motor 39 and accumulate this pulse number and then store it in a storage unit 250, and to then repeat this fact, and thereby calculate and detect the tape T dispensing position. By employing this structure, it is possible to accurately detect using the count value of the pulse number the end of the dispensing of the tape T in a winding operation and also a point near this end, and the end of the dispensing of the tape T in an unwinding operation and also a point near this end. However, the dispensing position of the tape T can only be detected this way when the winding operation and unwinding operation of the tape T are proceeding normally. If there is a banknote jam or the like, or the banknote collection drum 10 or the tape wind-on drum 12 are rotated manually by an operator, then it is no longer possible to accurately detect the tape T dispensing position. Accordingly, in cases such as this, it is sufficient if the dispensing position of the tape T is detected by means of the hardware-based detection described in the embodiment.

The sheet paper storage and dispensing device 1 of the present embodiment can be used, for example, as a storage section in an automated teller machine.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A sheet paper storage and dispensing device which stores and dispenses sheet paper, comprising:

a first reel drum onto which a tape is wound from one side of the tape;

a second reel drum on which sheet paper is stored by winding the tape thereon from an opposite side of the tape in a state in which the tape and sheet paper supplied from an external sheet paper transporting section to an intake/discharge port are mutually superimposed;

a motor which drives the first reel drum and the second reel drum via a drive system;

an electromagnetic clutch which switches between transmitting and interrupting drive force from the drive system;

an electromagnetic brake which applies a brake to the drive system;

a trigger sensor which detects supplying of the sheet paper from the sheet paper transporting section to the intake/discharge port, the trigger sensor detecting a distal end portion of the sheet paper supplied to the intake/discharge port;

a tape speed detection section which detects a transporting speed of the tape at the intake/discharge port;

a motor speed variation control unit which controls changes in a rotation speed of the motor;

a bottom roller which transports the tape by being in contact with the tape, the tape speed detection section provided at the bottom roller, at least a portion of the bottom roller being urethane rubber; and a winding control unit which causes a winding operation by controlling the electromagnetic clutch so as to transmit the driving force of the motor when supplying of the sheet paper to the intake/discharge port is detected by the trigger sensor, the winding operation being an operation in which the tape is dispensed from the first reel drum while the tape is wound onto the second reel drum, so that the sheet paper supplied to the intake/discharge port is wound onto the second reel drum, the winding control unit controlling the motor speed variation control unit such that, during the winding operation, the transporting speed of the tape detected by the tape speed detection section is held at a fixed speed which is faster by a predetermined amount than a transporting speed of the sheet paper transporting section, the winding control unit causing the electromagnetic clutch to interrupt the drive force from the drive system and causing the electromagnetic brake to apply the brake to the drive system, at a point in time when a predetermined time required for the sheet paper to be stored elapses after a point in time when the trigger sensor detects the distal end portion of the sheet paper supplied to the intake/discharge port.

2. The sheet paper storage and dispensing device according to claim 1, wherein the bottom roller is provided at the intake/discharge port and mutually superimposes the tape and the sheet paper.

3. The sheet paper storage and dispensing device according to claim 1, wherein a tape dispensing position is calculated using a pulse number of the motor speed variation control unit.

4. A sheet paper storage and dispensing device which stores and dispenses sheet paper, comprising:

a first reel drum onto which a tape is wound from one side of the tape;

a second reel drum on which sheet paper is stored by winding the tape thereon from an opposite side of the tape in a state in which the tape and sheet paper supplied from an external sheet paper transporting section to an intake/discharge port are mutually superimposed;

a motor which drives the first reel drum and the second reel drum via a drive system;

an electromagnetic clutch which switches between transmitting and interrupting drive force from the drive system;

an electromagnetic brake which applies a brake to the drive system;

a trigger sensor which detects supplying of the sheet paper from the sheet paper transporting section to the intake/discharge port, the trigger sensor detecting a distal end portion of the sheet paper supplied to the intake/discharge port;

a tape speed detection section which detects a transporting speed of the tape at the intake/discharge port;

a motor speed variation control unit which controls changes in a rotation speed of the motor;

a dispensing end detection section which detects that dispensing of the tape from the second reel drum is ended;

a bottom roller which transports the tape by being in contact with the tape, the tape speed detection section provided at the bottom roller, at least a portion of the bottom roller being urethane rubber;

a winding control unit which causes a winding operation by controlling the electromagnetic clutch so as to transmit the driving force of the motor when supplying of the sheet paper to the intake/discharge port is detected by the trigger sensor, the winding operation being an operation in which the tape is dispensed from the first reel drum while the tape is wound onto the second reel drum, so that the sheet paper supplied to the intake/discharge port is stored on the second reel drum; and an unwinding control unit which, during an unwinding operation, when end of dispensing of the tape is detected by the dispensing end detection section, controls the electromagnetic clutch so as to interrupt transmitting of the driving force of the motor, and controls the electromagnetic brake so as to apply a brake to the drive system, the unwinding operation being an operation in which the tape is dispensed from the second reel drum while the tape is wound onto the first reel drum, so that the sheet paper stored on the second reel drum is fed from the intake/discharge port to the sheet paper transporting section, the winding control unit controlling the motor speed variation control unit such that, during the winding operation, the transporting speed of the tape detected by the tape speed detection section is held at a fixed speed which is faster by a predetermined amount than a transporting speed of the sheet paper transporting section, and the unwinding control unit controlling the motor speed variation control unit such that, during the unwinding operation, the transporting speed of the tape detected by the tape speed detection section is held at a fixed speed which is slower by a predetermined amount than a transporting speed of the sheet paper transporting section, the winding control unit causing the electromagnetic clutch to interrupt the drive force from the drive system and causing the electromagnetic brake to apply the brake to the drive system, at a point in time when a predetermined time required for the sheet paper to be stored elapses after a point in time when the trigger sensor detects the distal end portion of the sheet paper supplied to the intake/discharge.

5. The sheet paper storage and dispensing device according to claim 4, wherein the bottom roller is provided at the intake/discharge port and mutually superimposes the tape and the sheet paper.

6. The sheet paper storage and dispensing device according to claim 4, wherein a tape dispensing position is calculated using a pulse number of the motor speed variation control unit.

* * * * *